US005430531A

United States Patent [19]

Kamiya

[11] Patent Number: 5,430,531

[45] Date of Patent: Jul. 4, 1995

[54] LOCKING APPARATUS FOR TONER CARTRIDGE

[75] Inventor: Daisaku Kamiya, Tokyo, Japan

[73] Assignee: Canon Kabushiki Kaisha, Tokyo, Japan

[21] Appl. No.: 172,321

[22] Filed: Dec. 21, 1993

[30] Foreign Application Priority Data

Dec. 28, 1992 [JP] Japan ..... 4-361505

[51] Int. Cl.[6] ..... G03G 15/06

[52] U.S. Cl. ..... 355/260; 222/DIG. 1

[58] Field of Search ..... 355/260; 222/DIG. 1

[56] References Cited

U.S. PATENT DOCUMENTS

| | | | |
|---|---|---|---|
| Re. 34,344 | 8/1993 | Sakato et al. | 355/260 X |
| 4,981,218 | 1/1991 | Ban et al. | 206/633 |
| 5,115,275 | 5/1992 | Suzuki | 355/260 X |
| 5,184,181 | 2/1993 | Kurando et al. | 355/260 |
| 5,196,884 | 3/1993 | Sugiyama et al. | 355/260 X |
| 5,289,243 | 2/1994 | Sakamoto | 355/260 |

FOREIGN PATENT DOCUMENTS

| | | |
|---|---|---|
| 63-220287 | 9/1988 | Japan . |
| 1-161391 | 6/1989 | Japan . |
| 4-66982 | 3/1992 | Japan . |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

When a developer supply cartridge is set at a predetermined position for discharging a developer into a developing device on a cartridge holding portion of the developing device, the developer supply cartridge is locked by a locking member so as to be detached from the predetermined position. When a sensor has detected that the amount of the developer remaining within the developing device has been reduced to an amount equal to or less than a predetermined amount, the locking is released in response to a signal from the sensor.

9 Claims, 30 Drawing Sheets

LOCKING APPARATUS FOR TONER CARTRIDGE

BACKGROUND OF THE INVENTION

1. Field of the Invention

This invention relates to a developing device used in an image forming apparatus using an electrophotographic method or an electrostatic recording method, such as a copier, a printer or the like, for forming a visual image by providing an electrostatic latent image formed on an image bearing member with a developer, and to a cartridge for supplying the apparatus with a developer.

2. Description of the Related Art

Since a developer within a developer receptacle provided in a developing device of such an image forming apparatus is consumed in accordance with the proceeding of image forming processes, it is necessary to replenish the developer appropriately. In general, the developer is replenished by supplying it from a developer supply cartridge to a developer receptacle.

For example, as described in U.S. Pat. No. 4,981,218, a developer supply cartridge is mounted in a developing device. In this state, the developer is supplied from an opening provided in the cartridge to a developer receptacle in the developing device. After the supply of the developer has been completed, the cartridge is immediately removed from the developing device.

However, the above-described conventional approach has the following problems:

(1) Even if the developer exceeding the permissible amount of the developer receptable for the developer has been supplied and the developer still remains in the developer supply cartridge, the developer supply cartridge can be detached from the developing device.

(2) The developer supply cartridge can be detached from the developing device even while the developer is supplied.

Hence, the operator may in some cases detach the developer supply cartridge from the developing device even if the developer still remains in the developer supply cartridge. As a result, particles of the developer remaining within the developer supply cartridge are scattered, thereby contaminating the inside or the neighborhood of the image forming device.

SUMMARY OF THE INVENTION

It is an object of the present invention to provide a developing device and a developer supply cartridge which can prevent scattering of a developer when the developer supply cartridge is detached from the developing device.

It is another object of the present invention to provide a developing device and a developer supply cartridge which can prevent the occurrence of such an accident that the developer supply cartridge is erroneously detached from the developing device in a state in which a large amount of developer remains within the developer supply cartridge.

It is still another object of the present invention to provide a developing device and a developer supply cartridge in which the developer supply cartridge can be used as a part of a developer receptable of the developing device until the developer supply cartridge is detached from the developing device.

According to one aspect, the present invention which achieves these objectives relates to a developing device for developing an electrostatic latent image , in which a developer supply cartridge is detachably mounted, including a receptacle for accommodating a developer discharged from a developer-discharging opening of the cartridge. The receptacle includes a cartridge-holding portion for holding the cartridge so that the developer is discharged from the opening into the receptable. The device further includes locking means, engaged with the cartridge held in the holding portion so that the developer can be discharged, for preventing a movement of the cartridge to detach the cartridge from the holding portion, detection means for detecting an amount of the developer within the receptacle, and control means for releasing a cartridge-locking operation of the locking means in response to a signal from the detection means when the amount of the developer within the receptacle has been reduced to an amount equal to or less than a predetermined amount.

According to another aspect, the present invention which achieves these objectives relates to a developer supply cartridge which is detachably mounted in a developing device, including detection means for detecting an amount of a developer within the device, for developing an electrostatic latent image. The cartridge includes a receptacle portion for accommodating the developer. The receptacle portion includes an opening for discharging the developer into the developing device. The cartridge further includes a sealing member for sealing the opening so as to be openable, and a locking-member-engaging portion for preventing detachment of the cartridge from a cartridge-holding portion of the developing device by engaging with a locking member of the developing device when the cartridge is held in the cartridge-holding portion so that the developer can be discharged from the opening into the developing device. The locking-member-engaging portion is released from the locking member by displacement of the locking member by driving means in response to the detection by the detection means that the amount of the developer within the developing device is reduced to an amount so as not to contact the cartridge held in the holding portion.

The foregoing and other objects, advantages and features of the present invention will become more apparent from the following description of the preferred embodiments taken in conjunction with the accompanying drawings.

BRIEF DESCRIPTION OF THE DRAWINGS

FIG. 13(*b*) is a side view of the principal portion shown in FIG. 13(*a*);

FIG. 14(*b*) is a side view of the principal portion shown in FIG. 14(*a*);

FIG. 15(*b*) is a side view of the principal portion shown in FIG. 15(*a*);

FIG. 16(*b*) is a side view of the principal portion shown in FIG. 16(*a*);

DESCRIPTION OF THE PREFERRED EMBODIMENTS

Figure 1:
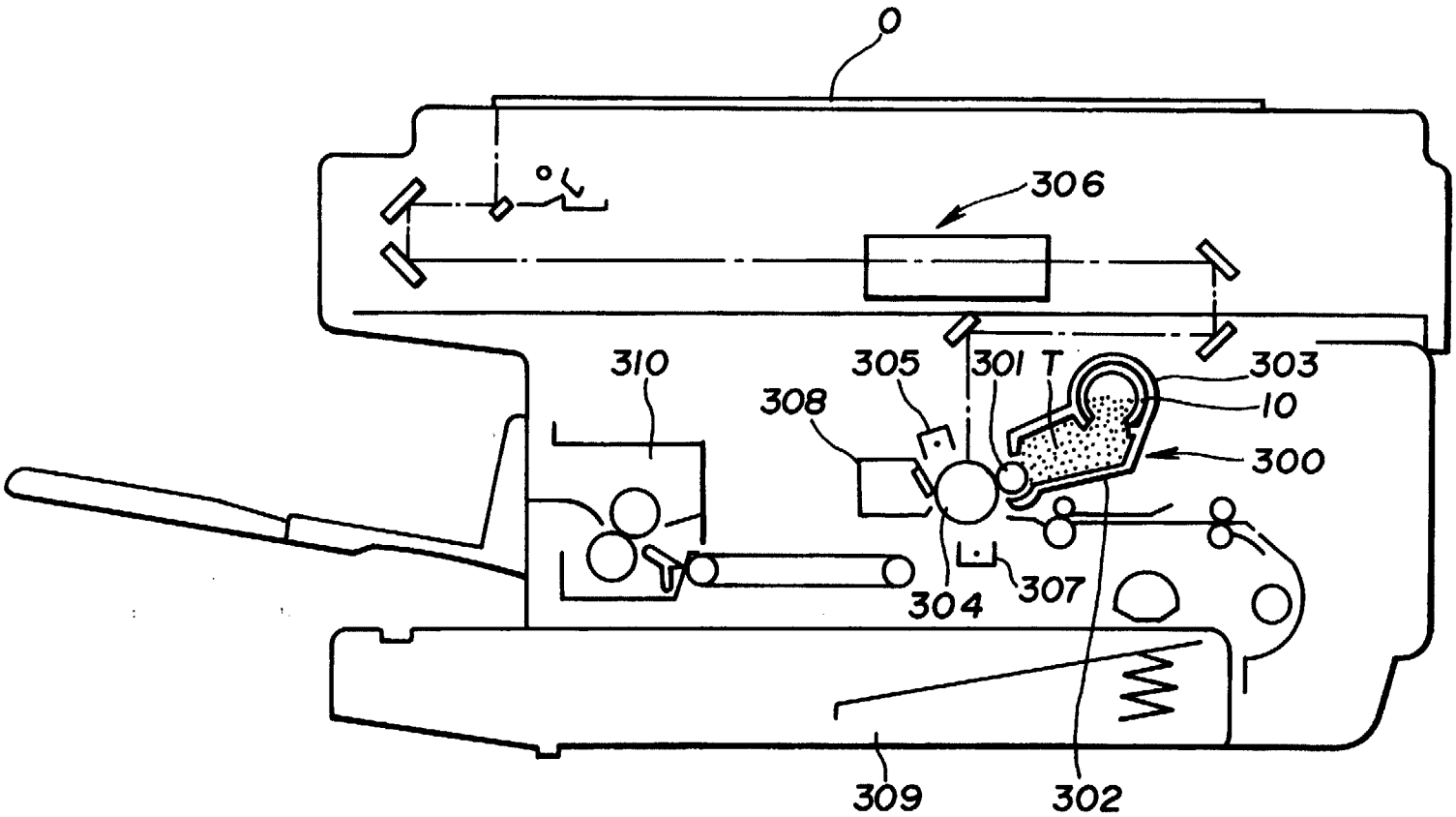
FIG. 1 is a diagram illustrating an electrophotographic apparatus to which the present invention can be applied.

FIG. 1 is a diagram illustrating an electrophotographic apparatus to which the present invention can be applied.

This apparatus includes an electrophotographic photosensitive drum 304 rotating in a clockwise direction. Drum 304 is first uniformly charged by charger 305. Thereafter, an optical image of original O is exposed onto drum by optical system 306, whereby an electrostatic latent image is formed on drum 304.

This electrostatic latent image is developed by developing device 300.

Developing device 300 includes a receptacle 302 for accommodating particles of a toner, serving as a developer. The toner within receptacle 302 is conveyed outside receptacle 302 by developing roller 301 rotating in a counterclockwise or clockwise direction, and is supplied to the electrostatic latent image on drum 304. A developing bias voltage is usually applied to developing roller 301 supported by receptacle 302.

Receptacle 302 includes a cartridge-holding portion 303. Toner supply cartridge 10 is detachably mounted in cartridge-holding portion 303.

As will be described later, cartridge 10 includes a toner-discharging opening, from which toner T is discharged into receptacle 302. In FIG. 1, cartridge 10 is positioned in holding portion 303 so that its opening is placed downward. Hence, toner T within cartridge 10 is discharged into receptacle 302 by the gravitational force. If a toner-discharging member, such as a rotating vane or the like, is provided within cartridge 10, cartridge 10 can be positioned in holding portion 303 so that its opening is laterally placed.

The toner image formed on drum 304 by developing device 300 is transferred onto transfer paper, which has been conveyed from transfer-paper accommodating unit 309 by conveying means, by transfer charger 307.

The toner image transferred to the transfer paper is fixed thereon by fixing device 310. Toner particles remaining on drum 304 are removed by cleaning unit 308.

Next, a description will be provided of a first embodiment of the present invention.

Figure 8:
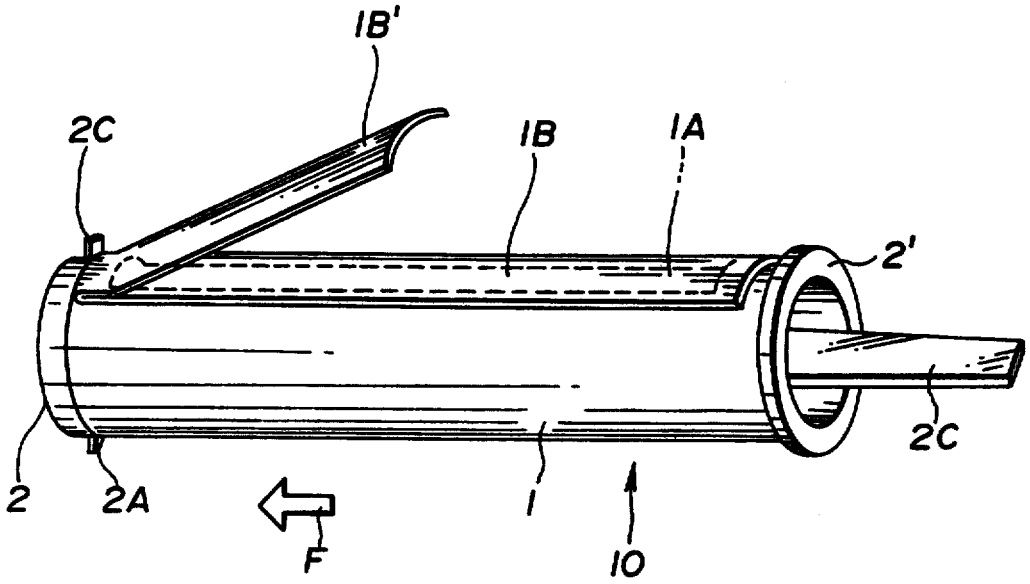
FIG. 8 is a perspective view of the cartridge of the first embodiment.

In FIG. 8, toner supply cartridge 10 includes a cylindrical receptable 1 for accommodating toner to be supplied. Two end portions of receptable 1 in the longitudinal direction are closed by lids 2 and 2'.

Toner-discharging opening 1A is formed on receptacle 1. This opening 1A is sealed by flexible film 1B peelably attached thereto on the outer circumferential surface of receptacle 1. This film 1B includes portion 1B' which is folded back at one end portion of receptacle 1. When unsealing opening 1A, the operator pulls the leading end of portion 1B' in a direction substantially opposite to the direction of arrow F to peel film 1B' from receptacle 1. Such a sealing/unsealing method itself is known.

A handle to be manually operated by the operator is provided on lid 2'. As will be described later, three projections 2A, 2B and 2C (projection 2B cannot be seen in FIG. 8) are provided on lid 2.

Projection 2A is a locking-member-engaging projection to engage with stopper pawl 3C (to be described later). Projection 2B is a lever-engaging projection to engage with lever 5 (to be described later). Projection 2C is a positioning projection for positioning the angular position of cartridge 1 by engaging with stopper 31 (to be described later).

As will be described later, cartridge 10 is rotated around its central axis after being inserted into cartridge-holding portion 303 of developing receptacle 302. In order that projections 2A and 2B can pass without interfering with stopper 31 at that time, projections 2A and 2B are provided at a position slightly more ahead than projection 2C in the direction F of insertion of cartridge 10 into holding portion 303.

Figure 9:
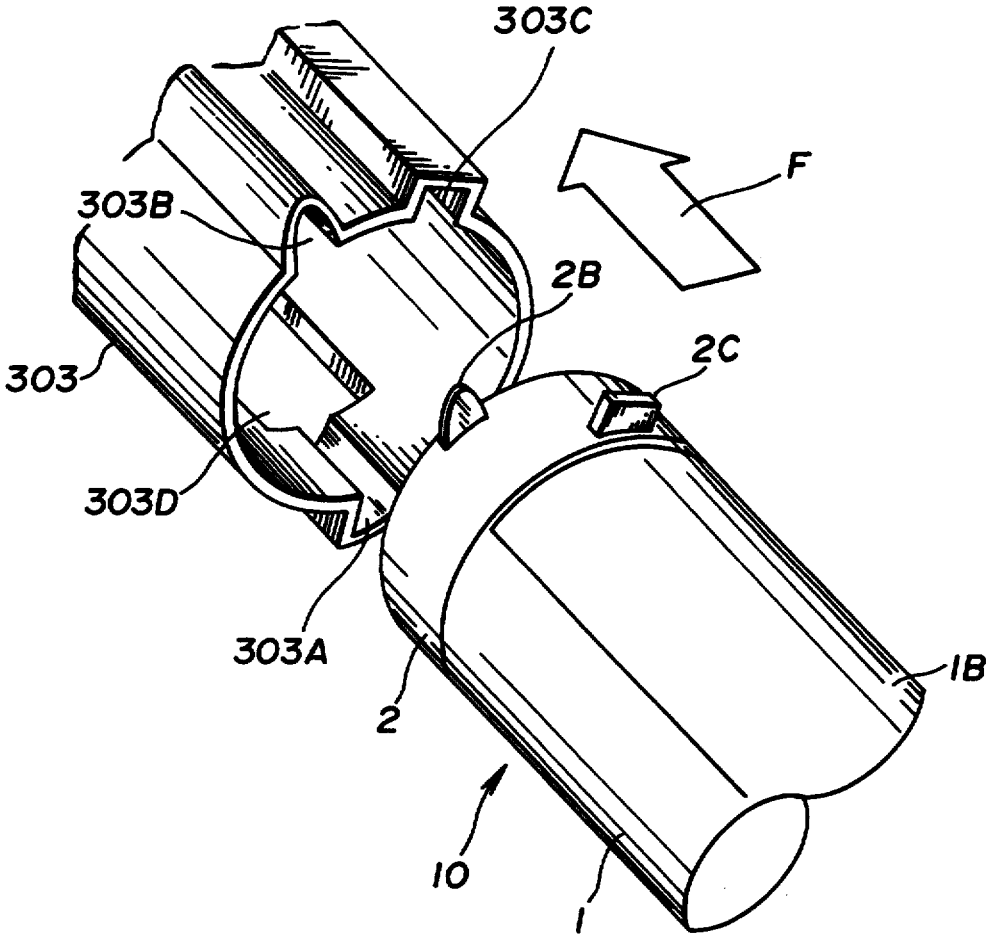
FIG. 9 is a partial perspective view of the cartridge and a holding portion of the first embodiment.

As shown in FIG. 9, cartridge 10 is inserted into holding portion 303 in the direction of arrow F from the side of lid 2. The direction of arrow F is the longitudinal direction of cartridge 10.

In order to maintain opening 1A in an upward state while cartridge 10 is inserted into holding portion 303 or while cartridge 10 is detached from holding portion 303 in a direction opposite to the direction of arrow F, guide grooves 303A, 303B and 303C are provided in holding portion 303. Guide grooves 303A, 303B and 303C guide projections 2A, 2B and 2C, respectively.

It is desirable that film 1B is removed from receptacle 1 while cartridge 10 moves in the direction of arrow F within holding portion 303, or when cartridge 10 is inserted up to an end position in holding portion 303 in the direction of arrow F.

Each of the above-described guide grooves ends at a position immediately before cartridge 10 reaches the above-described end position. Hence, when cartridge 10 reaches the above-described end position, it can rotate around its central axis. The operator rotates cartridge 10 in the direction of arrow R shown in FIG. 10 while holding the above-described handle until projection 2C contacts stopper 31. Toner-discharging opening 1A of cartridge 10 is thereby placed downward, and toner T within receptacle 1 is discharged into developing receptacle 302.

Figure 10:
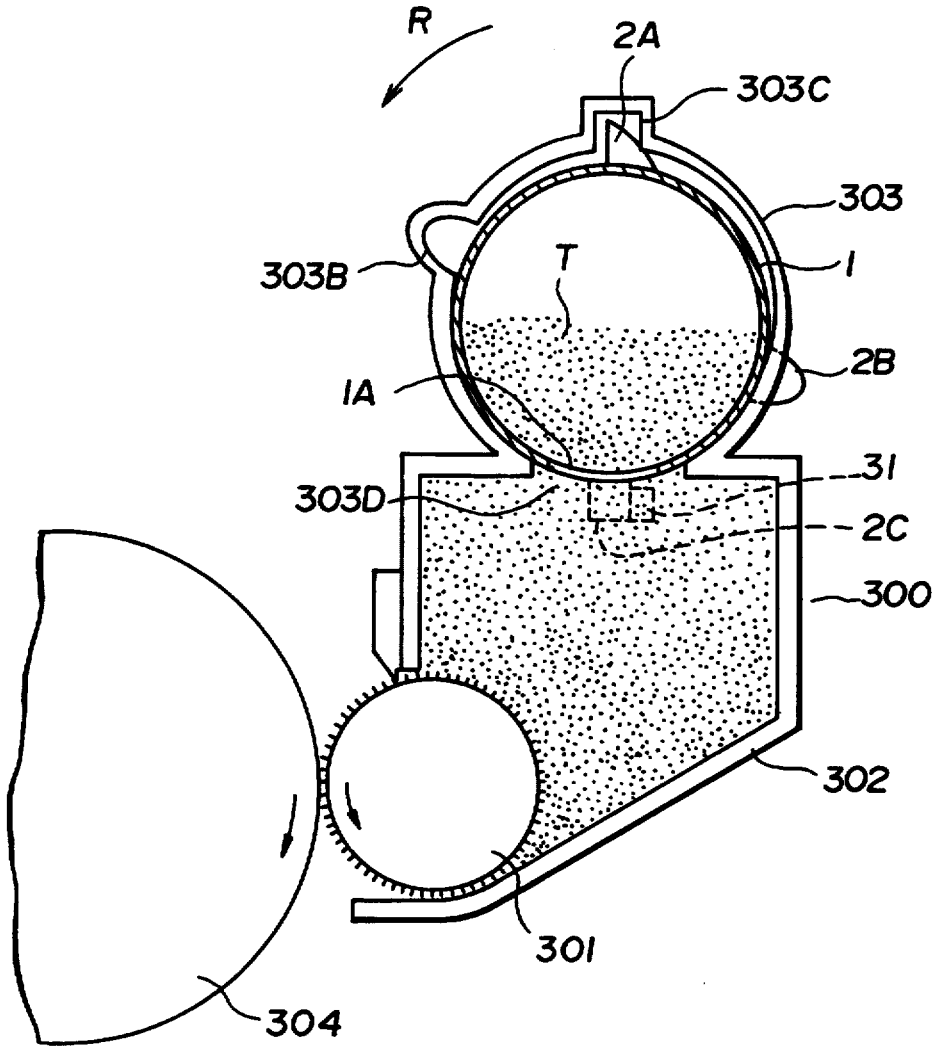
FIG. 10 is a diagram illustrating another principal portion of the device of the first embodiment.

In FIGS. 9 and 10, reference numeral 303D represents an opening provided in holding portion 303. Toner-discharging opening 1A of cartridge 10 positioned in a posture for discharging toner is placed within this opening 303D. Guide groove 303A is provided at two portions in front of and behind this opening 303D.

In order to detach cartridge 10 from the position shown in FIG. 10 outside the apparatus, cartridge 10 is rotated in a direction opposite to the direction of arrow R until projection 2C contacts a stopper (to be described later), and is then detached in a direction opposite to the direction of arrow F. Cartridge 10 is drawn outside the apparatus while projections 2A, 2B and 2C are guided by guide grooves 303A, 303B and 303C, respectively.

Figure 2:
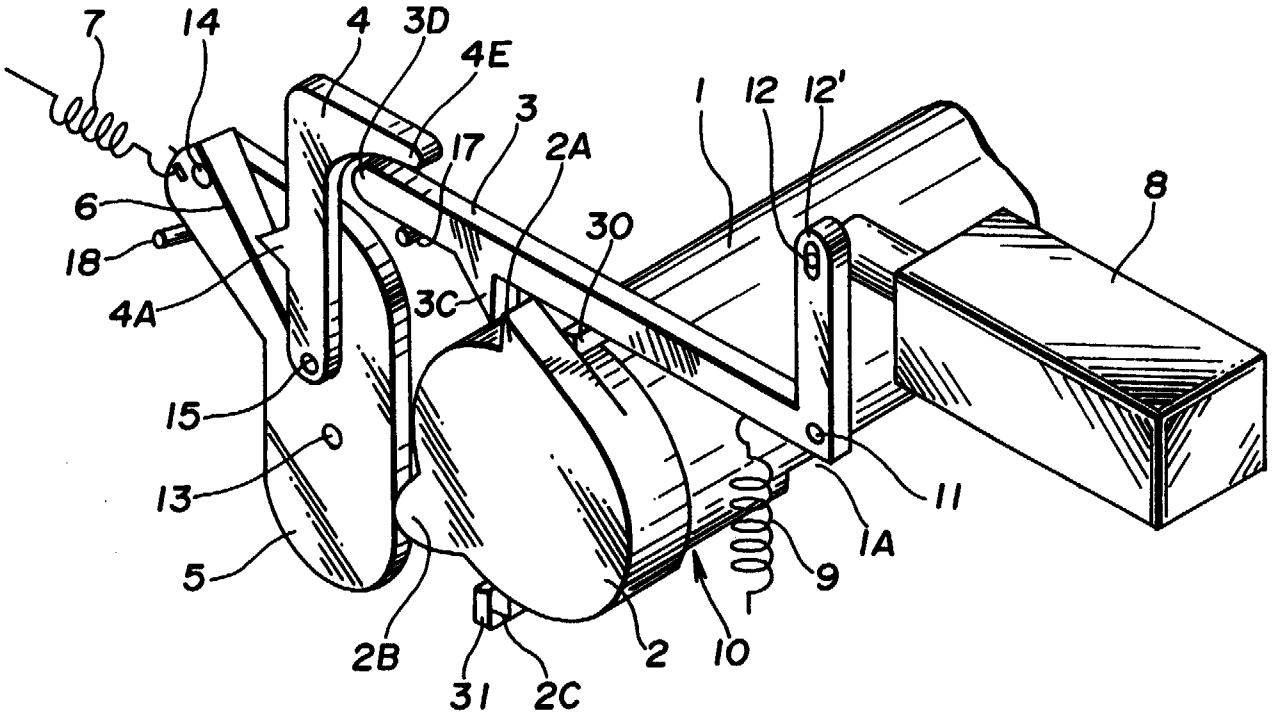
FIG. 2 is a perspective view of a principal portion of a device according to a first embodiment of the present invention.

FIG. 2 is a schematic perspective view illustrating a state in the first embodiment, in which developer (toner) supply cartridge 10 is inserted into holding portion 303 of developer receptacle 302, is then rotated, and is locked by a reverse-rotation prevention mechanism provided in developing device 300. FIGS. 3 through 7 are diagrams illustrating the operations of respective units in the first embodiment. FIGS. 2 through 7 are diagrams illustrating the apparatus as seen from the back of FIG.

As described above, developer supply cartridge 10 can rotate around its central axis after being inserted into cartridge-holding portion 303 of developer receptacle The angle of rotation of cartridge 10 is regulated by contact of projection 2C provided on the outer circumferential surface of cartridge 10 with two stoppers 30 and 31 provided on developer receptacle 302.

Locking member 3 can rotate around shaft 11, and stopper member 4, which engages with a leading-end portion of locking member 3, can rotate around shaft 15. When this stopper member 4 rotates in a counterclockwise direction, projection 4A of stopper member 4 presses leaf spring 6, one end of which is fixed on stopper member 4 and another end of which contacts stop member 14, and leaf spring 6 is deformed while increasing its elastic force. Stopper member 4 starts to rotate in a clockwise direction by the elastic force of leaf spring 6 when the force in the counterclockwise direction has been released, and is stopped by stop member Stopper base member 5, which rotatably supports stopper member 4, and on which the above-described stop members 14 and 16 are formed, is rotable around shaft 13, and is elastically rotatably driven in a counterclockwise direction by tension spring 7.

The above-described locking member 3 is elastically rotatably driven in a counterclockwise direction by tension spring 9. Stopper 17 prevents further rotation of locking member 3 from the locked position in a counterclockwise direction.

Slot 12' is provided in locking member 3, in which pin 12 provided on driving shaft 8' of electromagnetic solenoid 8 is fitted.

Electromagnetic solenoid 8 is mounted on developer receptacle 302, and is subjected to on/off control in response to a signal from remaining-amount detection sensor 47 for detecting a remaining amount of developer (toner) T within developer receptacle 302. A piezoelectric element or the like can be used as sensor 47.

Next, a description will be provided of the operations of respective units of the developer supply device of the present embodiment with reference to FIGS. 3 through 7.

Figure 3:
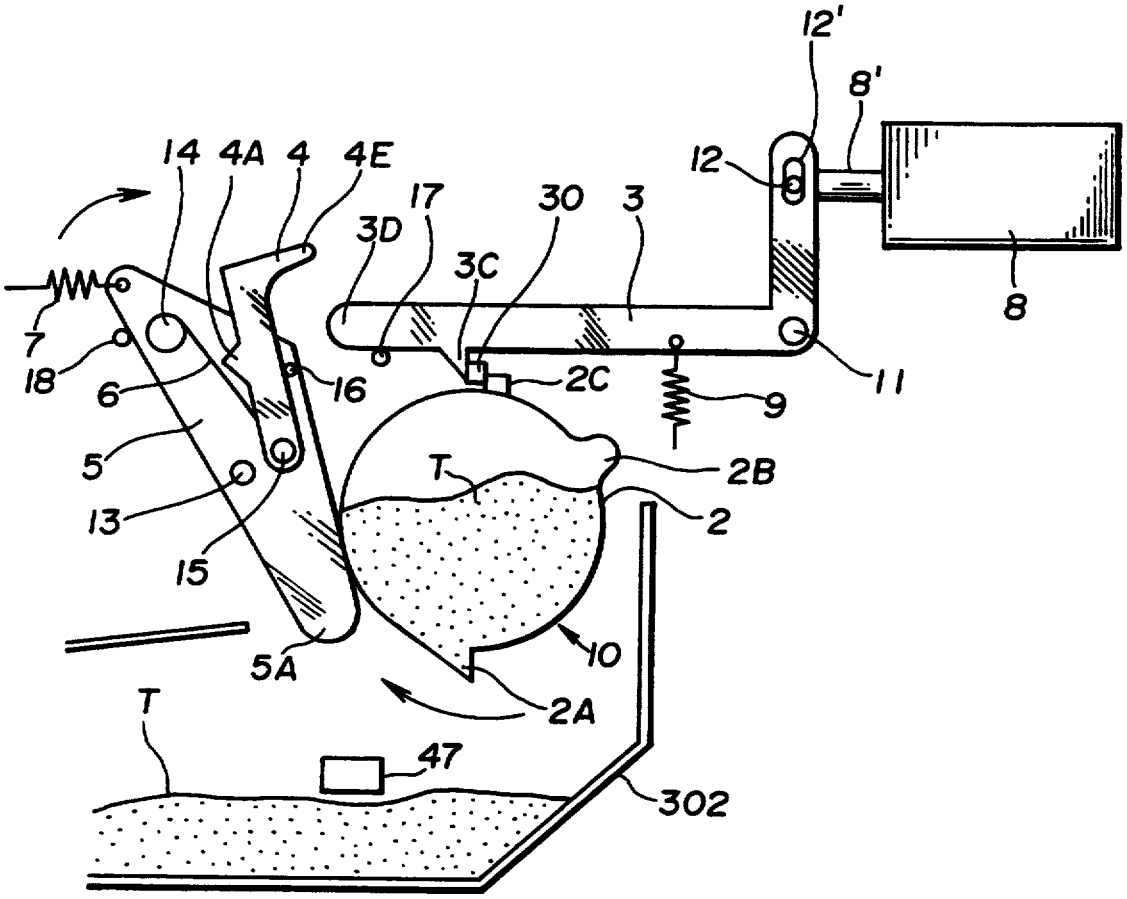
FIG. 3 is a diagram illustrating a state in which a cartridge is inserted within a developing device in the first embodiment.

As for the supply of the developer to developer receptacle 302, first, developer supply cartridge 10 is inserted into holding portion 303 of developer receptacle 302 in a state in which lid 2 of developer supply cartridge 10 is positioned as shown in FIG. 3. That is, developer supply cartridge 10 can be inserted only when lid 2 assumes the posture shown in FIG. 3. At that time, developer-discharging opening 1A (see FIG. 8) is placed upward, so that the developer is not discharged.

Figure 4:
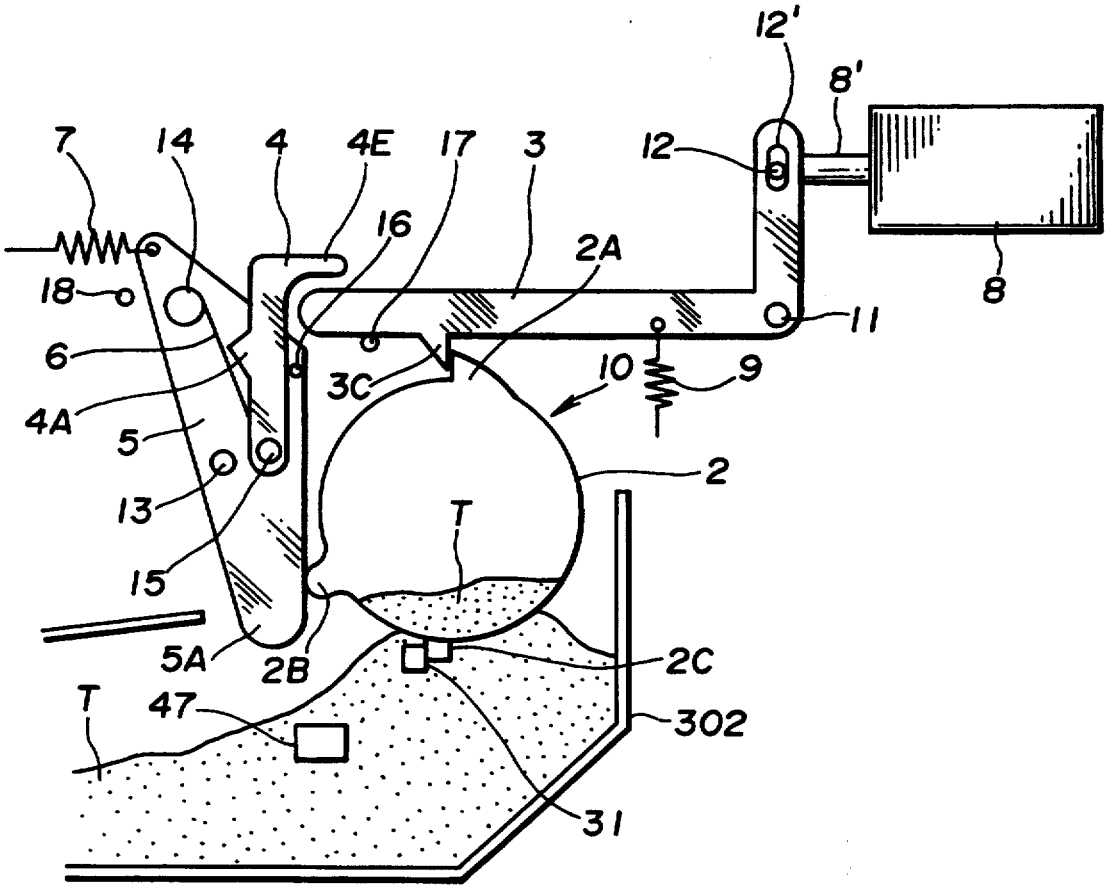
FIG. 4 is a diagram illustrating a state in which the cartridge is locked in the first embodiment.

Thereafter, in order to supply developer T within developer supply cartridge 10 to developer receptacle 302, cartridge 10 is rotated from the state shown in FIG. 3 in a clockwise direction as indicated by the arrow. At that time, as shown in FIG. 4, projection 2A of lid 2 raises projection 3C of locking member 3 against the elastic force of spring 9, and projection 2C of developer supply cartridge 10 contacts stopper 31 immediately after projection 2A of lid 2 has passed through projection 3C of locking member 3, whereby the rotation of developer supply cartridge 10 in the clockwise direction is stopped. Projection 2B of lid 2 pushes end portion 5A of member 5 from the right as viewed in FIG. 3 to rotate member 5 in a clockwise direction, and member 5 stops in a state in which its end portion 5A is kept pushed by projection 2B of lid 2 that stops at the above-described predetermined position (in the state shown in FIG. 4).

Since opening 1A of cartridge 10 is placed downward in a state in which cartridge 10 is positioned at the above-described predetermined angular position, developer T is supplied into developer receptacle 302.

As soon as projection 2A has passed through projection 3C of locking member 3, locking member 3, which has been rotated in a clockwise direction by projection 2A, is rotated in a counterclockwise direction by the elastic force of spring 9 until it contacts stopper 17, and projection 3C returns to the locking position (see FIG. 4). Thus, projection 2A of cartridge 10 assumes a locked state of engaging with projection 3C of locking member 3, thereby preventing the rotation of cartridge 10 in a counterclockwise direction. Accordingly, cartridge 10 cannot be detached from holding portion 303.

Figure 5:
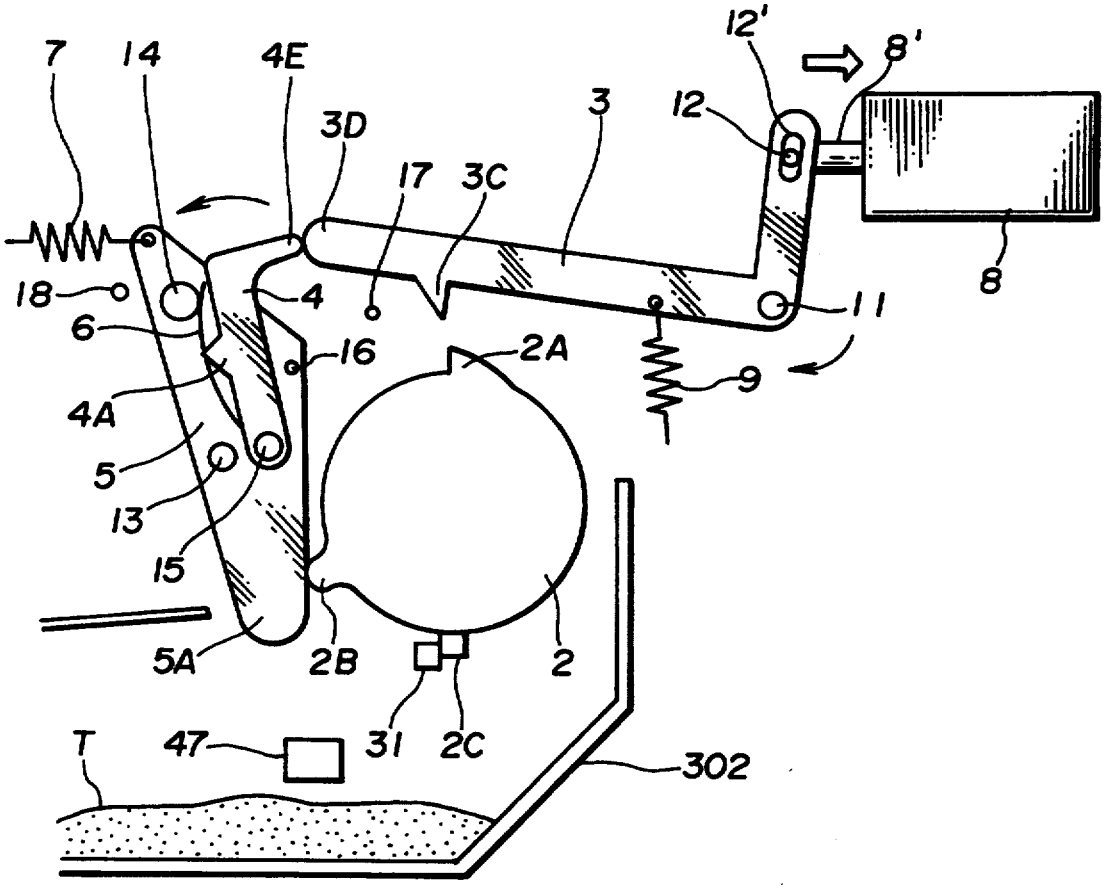
FIG. 5 is a diagram illustrating a locking-releasing operation in the first embodiment.

When the developer has been consumed in accordance with the proceeding of image forming processes, and remaining-amount detection sensor 47 of the developing device has detected that the amount of developer T within developer receptacle 302 becomes less than a predetermined amount, that is, that the surface of the layer of developer particles does not contact cartridge 10, a detection signal from sensor 47 is transmitted to solenoid 8, which operates to pull its driving shaft 8' (see the thick hollow arrow shown in FIG. 5). Hence, locking member 3 starts to rotate around shaft 11 in a clockwise direction by shaft 12 provided at an end portion of driving shaft 8' of solenoid 8. Projection 2A of cartridge 10 is thereby released from projection 3C of locking member 3. By the rotation of locking member 3, end portion 3D of locking member 3 pushes end portion 4E of stopper member 4. Hence, stopper member 4 rotates in a counterclockwise direction while bending leaf spring 6, as shown in FIG. 5.

Figure 6:
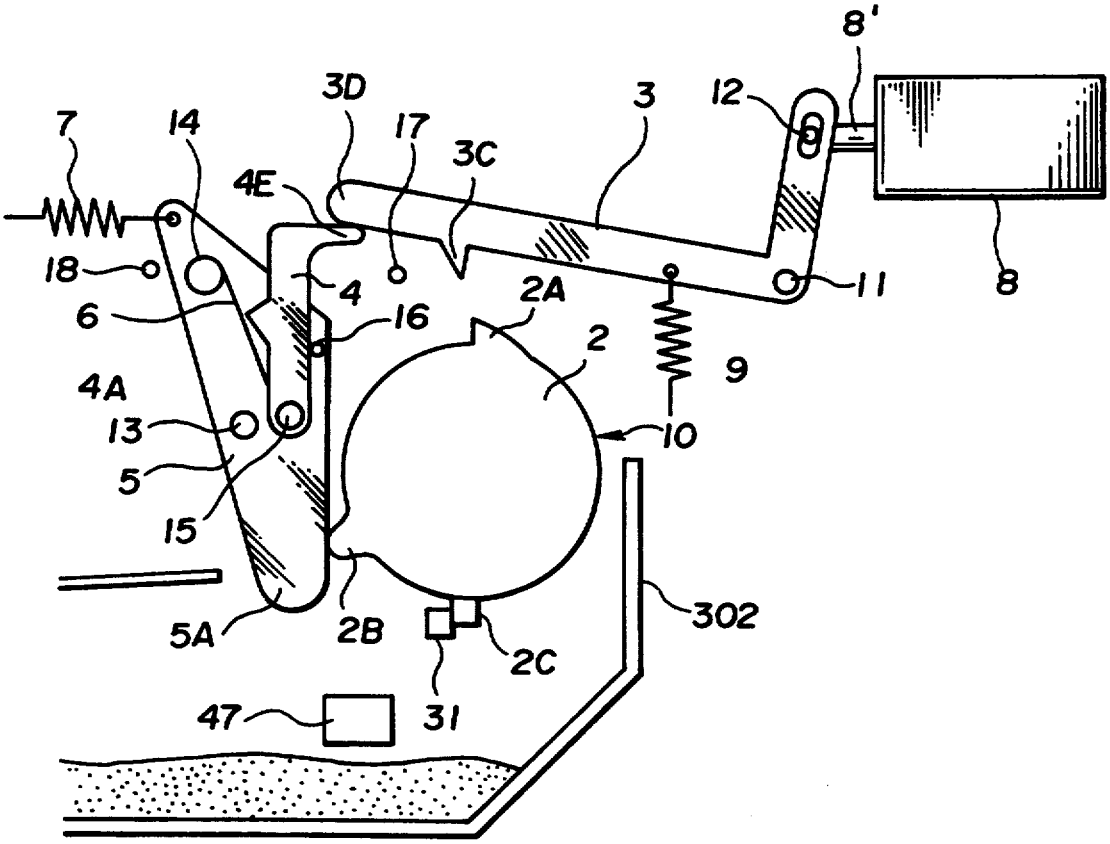
FIG. 6 is a diagram illustrating a state in which the locking-releasing operation has been completed in the first embodiment.

When solenoid 8 has completely retracted its driving shaft, locking member 3 is further pulled from the position shown in FIG. 5, as shown in FIG. 6, and its end portion 3D is positioned above end portion 4E of stopper member 4. At the same time, stopper member 4 returns to its original position by the elastic force of leaf spring 6. Accordingly, locking member 3 is pulled downward by tension spring 9, and is stabilized at the position shown in FIG. 6 while engaging with stopper member 4. In this state, developer supply cartridge 10 can rotate in a counterclockwise direction. At that time, substantially all the toner particles within cartridge 10 have been discharged within receptacle 302.

Figure 7:
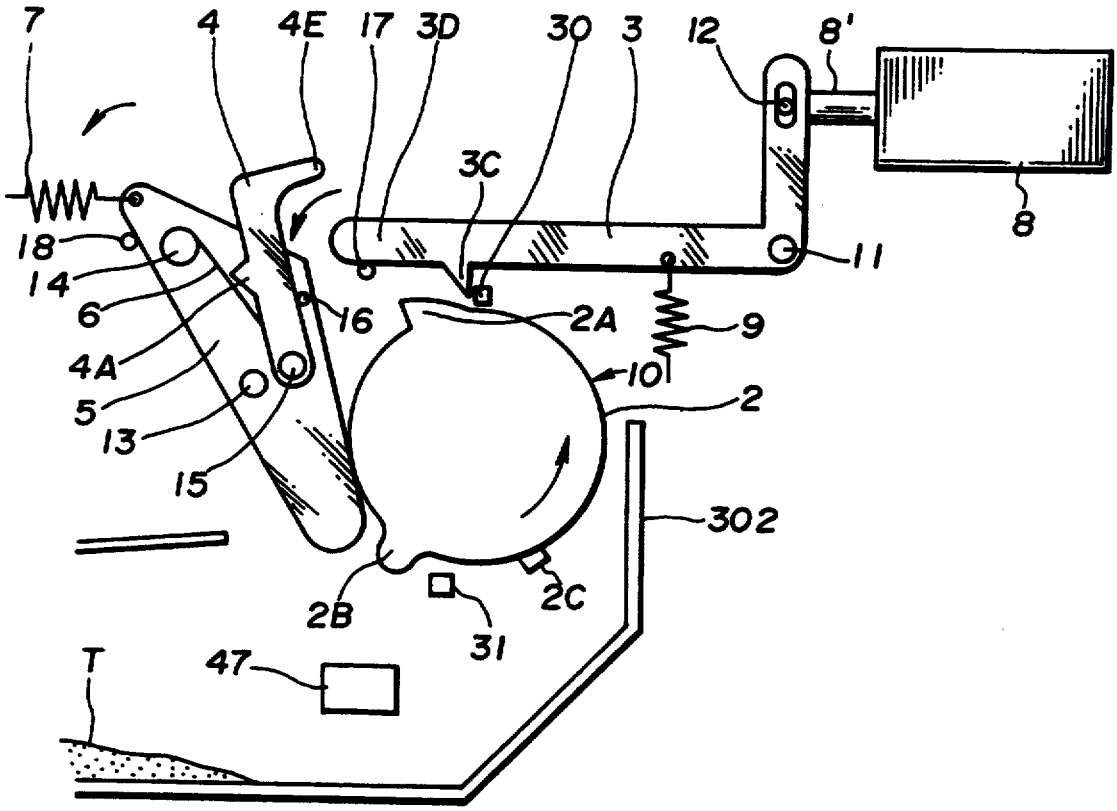
FIG. 7 is a diagram illustrating a first step of an operation of detaching the cartridge in the first embodiment.

If developer supply cartridge 10 is rotated in a counterclockwise direction from the position shown in FIG. 6, as shown in FIG. 7, projection 2A of cartridge 10 passes through projection 3C of locking member 3, and projection 2B of lid 2, which has contacted member 5, leaves the right side of member 5. At that time, member 5 starts to rotate around shaft 13 in a counterclockwise direction by tension spring 7, and is stabilized at a position of contacting stopper 18. At the same time, end portion 4E of member 4 leaves end portion 3D of locking member 3. Accordingly, locking member 3 is pulled downward by tension spring 9, and is stopped by stop shaft 17.

If the operator rotates cartridge 10 further in a counterclockwise direction, projection 2C of cartridge 10 contacts stopper 30, and cartridge 10 is stopped in the posture shown in FIG. 3.

In the above-described manner, the operator to supply the developer can detach developer supply cartridge 10 inserted in developer receptacle 302. At that time, no developer particles remain within developer supply cartridge 10, and the developer within receptacle 302 does not contact cartridge 10. Hence, even if cartridge 10 is detached in a direction opposite to the direction of arrow F, the scattering of developer particles does not occur.

Figure 11:
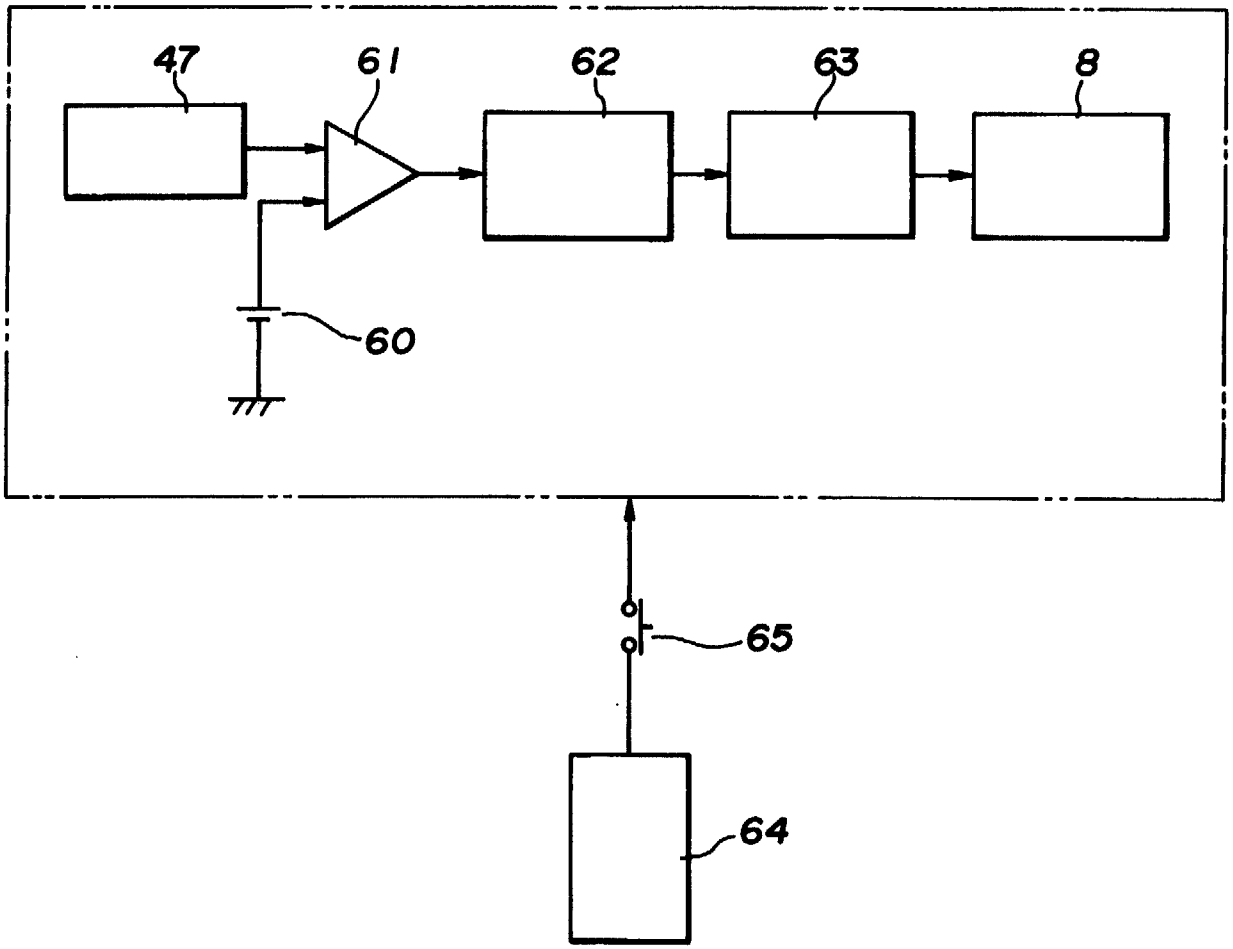
FIG. 11 is a diagram illustrating control means.

FIG. 11 is a diagram illustrating a control circuit for electromagnetic solenoid 8.

An output signal from sensor 47 is supplied to comparison circuit 61 to which a reference signal from reference-signal generation source 60 is supplied. When comparator 61 has determined that the amount of toner particles remaining within receptacle 302 has become equal to or less than the above-described predetermined amount based on the signal from sensor 47, control circuit 62 energizes solenoid-driving circuit 63, which supplies current to electromagnetic solenoid 8 to excite it, whereby projection 3C of locking member 3 is retracted from the locking position to an unlocking position in the above-described manner.

Immediately after projection 3C of locking member 3 has retracted to the unlocking position and locking member 3 has been held at the position shown in FIG. 6 by stopper 4, the current supply to solenoid 8 is interrupted to deenergize solenoid 8.

However, since locking member 3 is prevented from returning to the locking position by stopper 4, locking member 3 does not return to the locking position unless the operator rotates cartridge 10 in a counterclockwise direction as shown in FIG. 7.

Accordingly, even if the operator opens main switch 65 for supplying current from external power supply 64 to the circuit system shown in FIG. 11, locking member 3 cannot return to the locking position.

In other words, the operator can replace the cartridge at any time after the cartridge-locking operation of locking member 3 has been released.

Next, a description will be provided of a second embodiment of the present invention, which aims at reducing the size and the production cost of the apparatus, with reference to FIGS. 12 through 17.

Figure 12:
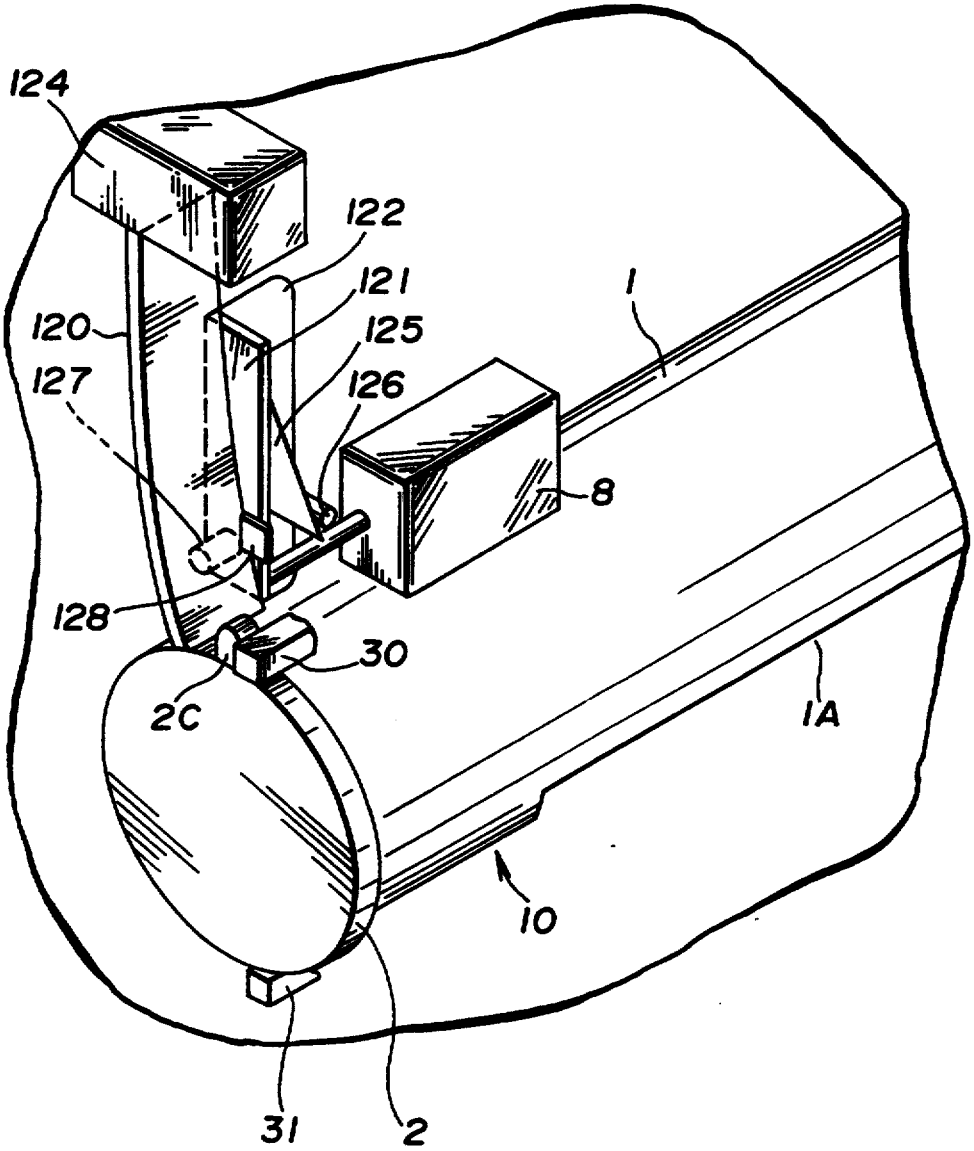
FIG. 12 is a perspective view of a principal portion of a device according to a second embodiment of the present invention.

FIG. 12 is a schematic perspective view illustrating a state in the second embodiment, in which developer supply cartridge 10 is inserted into developer receptacle 302, is then rotated, and is locked by a reverse-rotation prevention mechanism. FIGS. 13 through 17 are diagrams illustrating the operations of respective units of the developer supply device of the present embodiment.

In the second embodiment, the cartridge and the holding portion have the same configuration as in the above-described embodiment, except that cartridge 10 has only one projection 2C on lid 2, and cartridge holding portion 303 also has only a guide groove for this projection 2C. In the second embodiment, however, projection 2C is provided at a position substantially shifted from opening 1A of cartridge 10 by 180°.

Figure 13B:
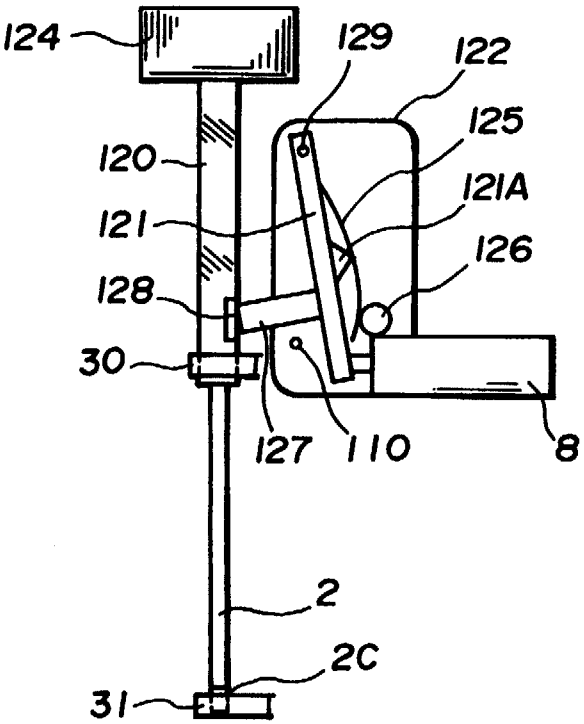
FIG. 13(*a*) is a front view of the principal portion illustrating a state in which a cartridge is inserted within a developing device in the second embodiment.
Figure 13A:
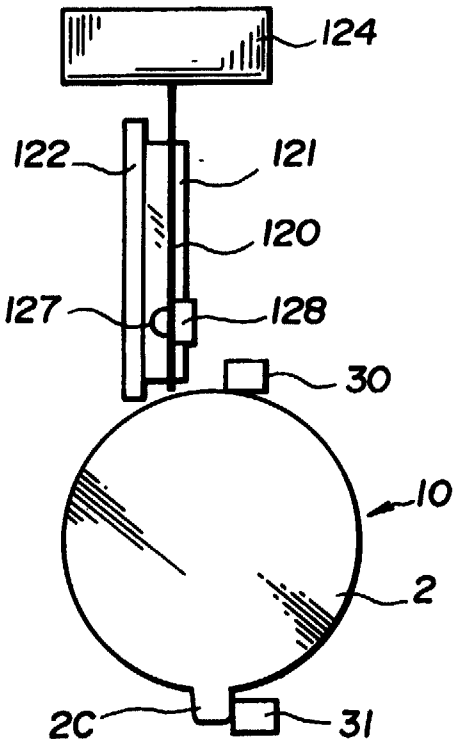

FIGS. 13(*a*) and 13(*b*) illustrate a state in which cartridge 10 is inserted within holding portion 303 while linearly moving. In this state, opening 1A of cartridge 10 is placed upward. Cartridge 10 is rotated from this posture in a counterclockwise direction by the operator.

In FIGS. 13(*a*) and 13(*b*), member 124 is fixed, and plate 120 made of an elastic member, which extends up to the neighborhood of the outer circumferential surface of lid 2 in a direction substantially perpendicular to the direction of the axis of developer supply cartridge 10, is supported by member 124 in the form of a cantilever. As shown in FIGS. 13(*a*) and 13(*b*), projecting member 128, which projects from a side (the right side as viewed in FIGS. 13(*a*) and 13(*b*)) of elastic plate 120 substantially perpendicularly to the plane of plate 120, is provided on plate 120.

Member 121 is supported so as to be rotatable around shaft 129 mounted on supporting plate 122. When member 121 is rotated around shaft 129 in a counterclockwise direction by the operation of solenoid 8, projection 121A of member 121 presses leaf spring 125 provided on member 121. Hence, leaf spring 125 is bent as shown in FIG. 13(*b*), since its free end contacts stop member 126.

Even if solenoid 8 is deenergized in this state, the rotation of member 121 in a clockwise direction is prevented since the leading end of projecting member 127 provided on member 121 contacts projection 128 of member 120, as shown in FIG. 13(*b*).

In the state shown in FIGS. 13(*a*) and 13(*b*), the leading end of projecting member 127 of member 121 contacts projecting member 128 of elastic plate 120. Hence, elastic plate 120 can be bent by an external force in a direction perpendicular to the direction of the axis of developer supply cartridge 10 in the same direction as that of the external force by an amount corresponding to the force, by functioning as a cantilever supported on member 124.

Figure 14B:
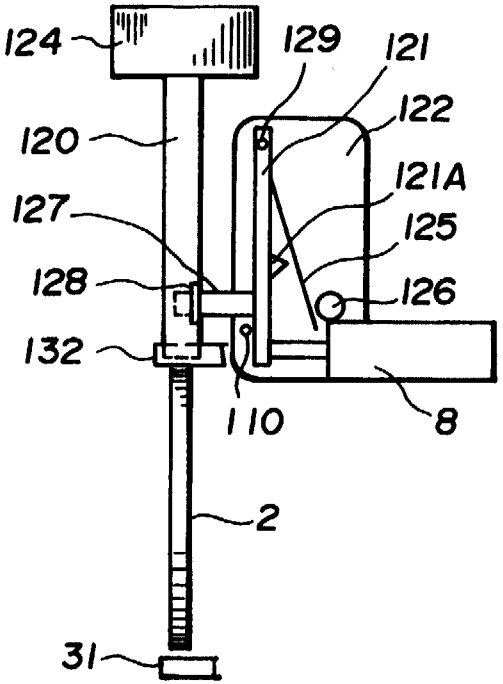
FIG. 14(*a*) is a front view of the principal portion illustrating a state immediately before the cartridge is locked in the second embodiment.
Figure 14A:
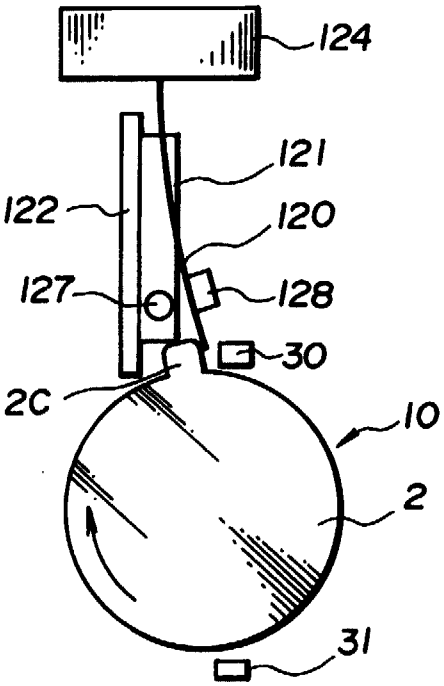

Then, in order to supply developer receptacle 302 with the developer within developer supply cartridge 10, developer supply cartridge 10 is rotated in a clockwise direction from the position shown in FIGS. 13(*a*) and 13(*b*). FIGS. 14(*a*) and 14(*b*) illustrate a state in which developer supply cartridge 10 is rotating immediately before it reaches a predetermined supply position for supplying the developer. As shown in FIG. 14(*a*), projection 2C of lid 2 applies an external force to elastic plate 120 to bend it by a considerable amount. By this bent state of elastic plate 120, the contact between the leading end of projecting member 127 of member 121 and projecting member 128 of elastic plate 120 is released. Hence, member 121 and its projecting member 127, whose rotation in a clockwise direction has been prevented by elastic plate 120 and its projecting member 128, return to the position shown in FIG. 14(*b*) (the position where member 121 contacts stop member 110) by the elastic force stored in leaf spring 125.

Figure 15B:
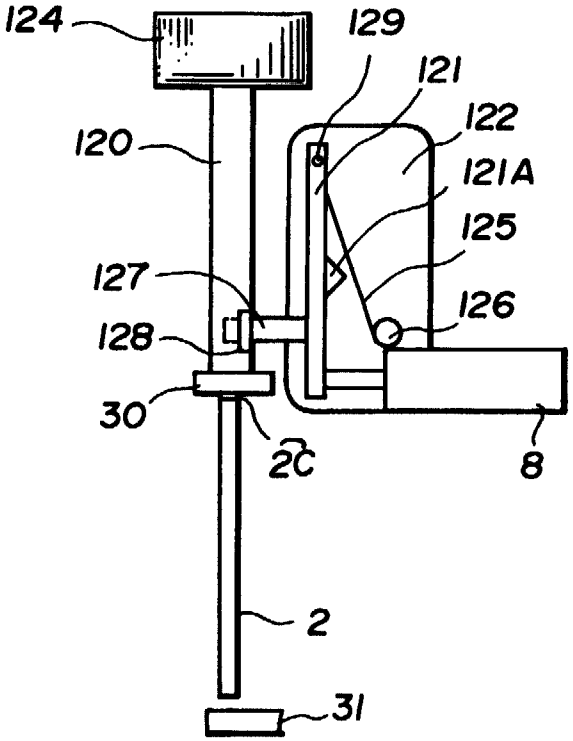
FIG. 15(*a*) is a front view of the principal portion illustrating a state in which the cartridge is locked in the second embodiment.
Figure 15A:
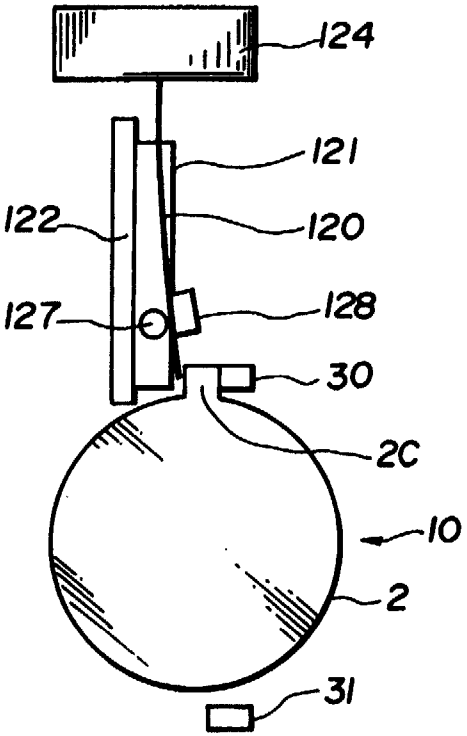

FIGS. 15(*a*) and 15(*b*) illustrate a state in which developer supply cartridge 10 is rotated and locked at a predetermined supply position in order to supply the developer. As shown in FIG. 15(*a*), since projection 2C of lid 2 contacts stopper 30 immediately after projection 2C has passed through the leading end of elastic plate 120 while bending it, the rotation of developer supply cartridge 10 in the clockwise direction is stopped. At the same time, elastic plate 120 intends to return to its original position by the elastic force stored therein. However, as shown in FIG. 15(*a*), projecting member 127 of member 121 extends to a side where elastic plate 120 intends to return, elastic plate 120 stops at a position where it contacts projecting member 127. That is, elastic plate 120 is maintained in a slightly bent state.

In the state shown in FIGS. 15(*a*) and 15(*b*), elastic plate 120 is held by member 124 in the form of a cantilever, and is supported at a one point by projecting member 127. Hence, the amount of bending of the leading end of elastic plate 120 does not reach an amount to allow projection of lid 2 to pass through the leading end of elastic plate 120 by an external force applied to projection 2C by the operator. That is, the rotation of developer supply cartridge 10 in a counterclockwise direction is practically impossible. Accordingly, developer supply cartridge 10 is locked at the position shown in FIGS. 15(*a*) and 15(*b*). At that time, since opening 1A of developer supply cartridge 10 is placed downward, the developer is supplied within developer supply receptacle 302.

Figure 16B:
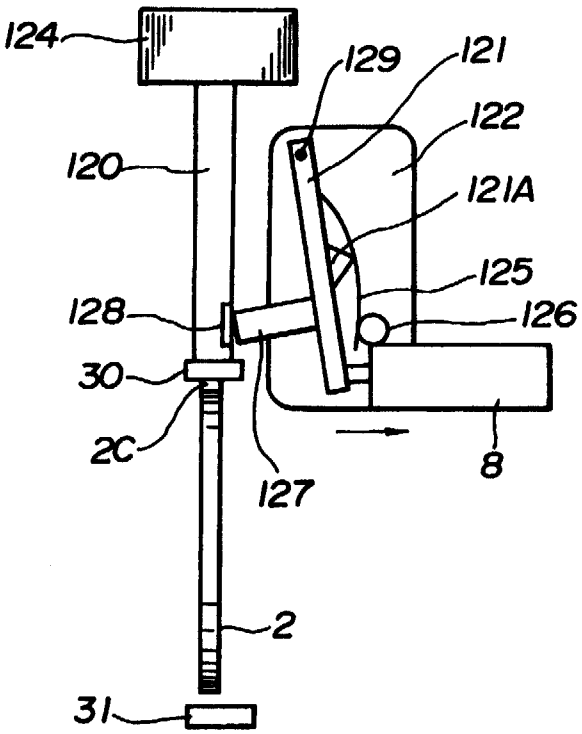
FIG. 16(*a*) is a front view of the principal portion illustrating a state in which the locking of the cartridge is released.
Figure 16A:
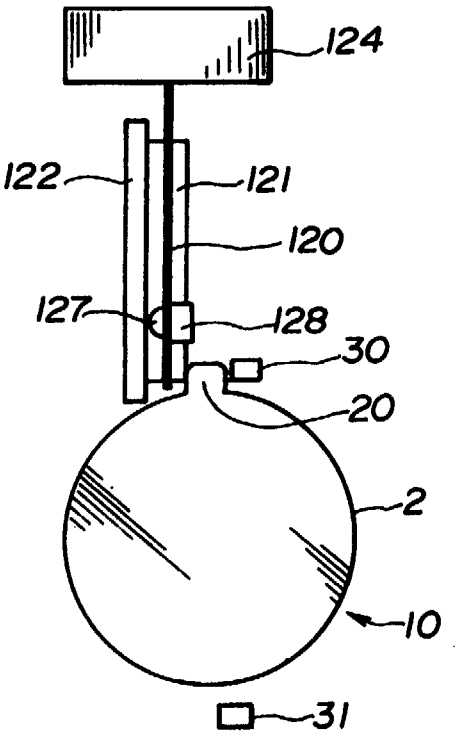

When the developer has been consumed in accordance with the proceeding of image forming processes, and the above-described remaining-amount detection sensor of the developing device has detected that the amount of the developer within developer receptacle 302 becomes less than a predetermined amount, a detection signal from the sensor is transmitted to solenoid 8, which operates to pull its driving shaft (see the arrow shown in FIG. 16(*b*)), in the same manner as described with reference to FIG. 11. Hence, member 121 linked with the driving shaft of solenoid 8 rotates around shaft 129 in a counterclockwise direction. At that same time, projecting member 127 mounted on member 121 also rotates in a counterclockwise direction, and stops at the position shown in FIG. 16(*b*).

By the rotation of members 121 and 127 in the counterclockwise direction, the locked state of elastic plate 120 is released. Hence, elastic plate 120 returns to its original position by its elastic force, whereby the leading end of projecting member 127 of member 121 contacts again projecting member 128 of elastic member 120 to provide the state shown in FIGS. 16(*a*) and 16(*b*).

Immediately after the state shown in FIGS. 16(*a*) and 16(*b*) has been provided, current supply to electromagnetic solenoid 8 is interrupted. However, since projecting member 127 of member 121 contacts projecting member 128 of elastic plate 120, projecting member 127 is held at the position shown in FIGS. 16(*a*) and 16(*b*) against the elastic force of leaf spring 125.

Accordingly, the state of releasing the cartridge locking is maintained until the operator performs an operation to detach the cartridge from the holding portion, even if the main switch is turned off.

In the state shown in FIGS. 16(*a*) and 16(*b*), elastic plate 120 is supported by member 124 in the form of a cantilever. Hence, as shown in FIG. 17, the leading end of elastic plate 120 is easily bent by an amount to allow projection 2C of lid 2 to pass through the leading end of elastic plate 120 by an external force in a counterclockwise direction applied by projection 2C.

Accordingly, developer supply cartridge 10 is rotated in a counterclockwise direction until its projection 2C contacts stopper 31. That is, the state shown in FIGS. 13(*a*) and 13(*b*) is again provided. Thereafter, developer supply cartridge 10 is detached from holding portion 303. Since substantially all the developer particles within developer supply cartridge 10 have already been discharged within developer receptacle 302, no developer particles remain within developer supply cartridge 10 detached from holding portion 303.

Figure 17:
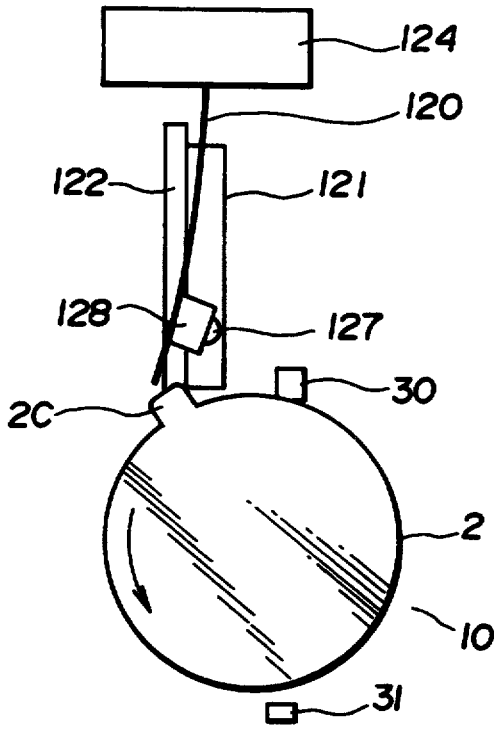
FIG. 17 is a front view of the principal portion illustrating a state in which the rotation of the cartridge for being detached from a predetermined position is started in the second embodiment.

As shown in FIG. 17, projecting member 128 of elastic plate 120 protrudes by an amount sufficient enough to maintain the contact state with the leading end of projecting member 127 of member 121. Hence, member 121 and its projecting member 127 are kept held at the position shown in FIGS. 16(*a*) and 16(*b*).

Next, a description will be provided of a third embodiment of the present invention, in which the above-described first embodiment is improved, with reference to FIGS. 18 through 21. In the third embodiment, a reverse rotational force is stored by the rotation of developer supply cartridge 10 to the developer supply position. When the remaining-amount detection sensor has detected that the amount of developer particles within developer receptacle 302 becomes less than a predetermined amount, developer supply cartridge 10 is rotated from the developer supply position in a reverse direction by the stored reverse rotational force to be returned to a position where it can be detached from holding portion 303.

Figure 18:
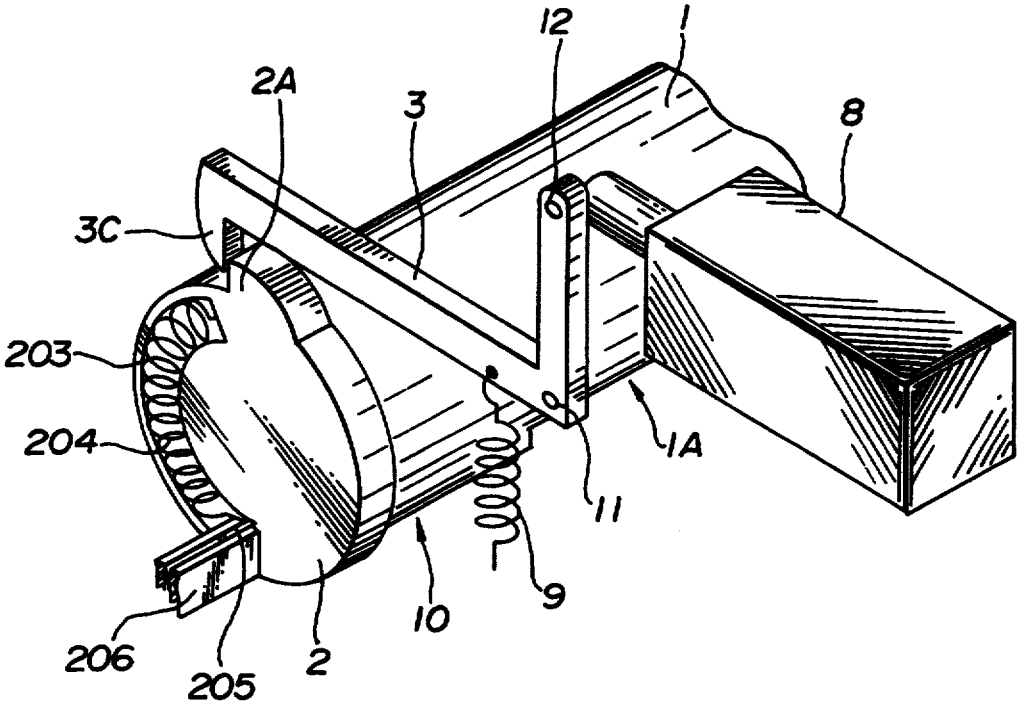
FIG. 18 is a perspective view of a principal portion of a device according to a third embodiment of the present invention.
Figure 19:
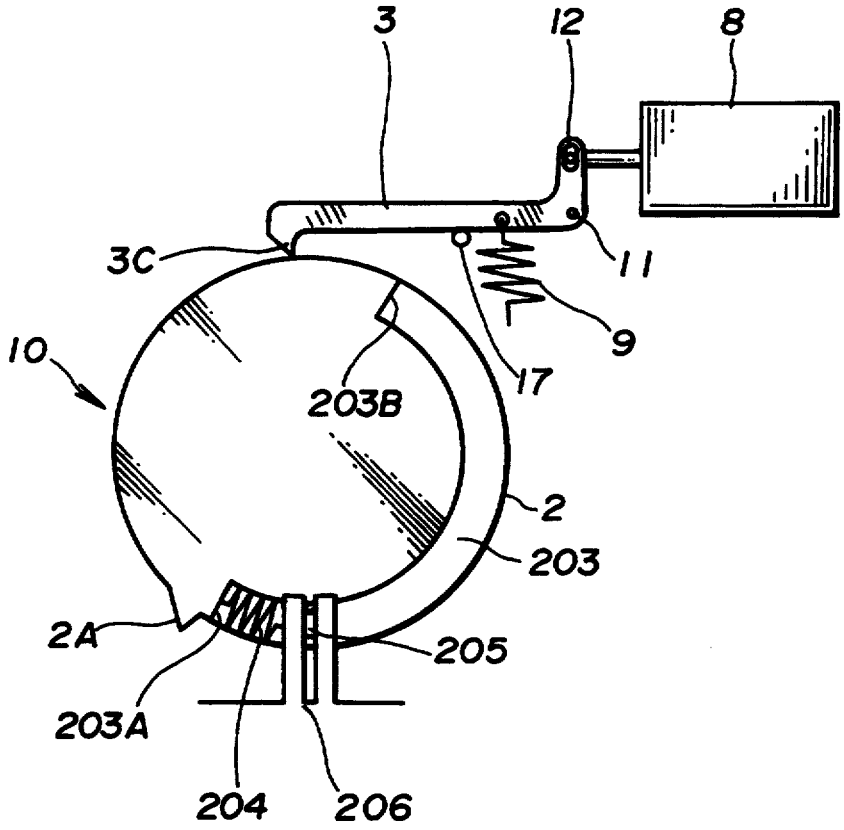
FIG. 19 is a diagram illustrating a state in which a cartridge is inserted within a developing device in the third embodiment.
Figure 20:
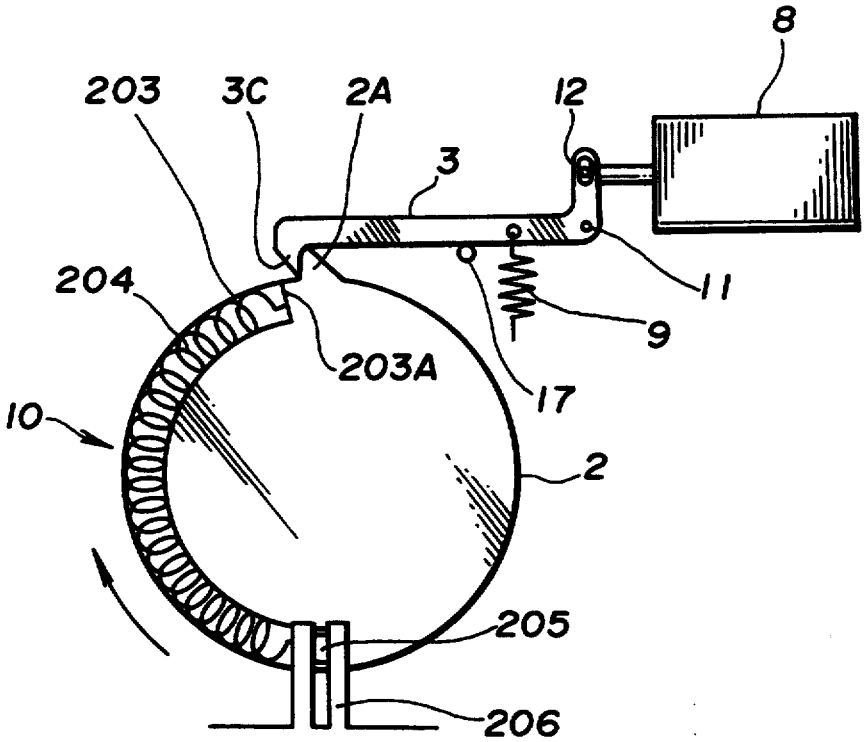
FIG. 20 is a diagram illustrating a state in which the cartridge is locked in the third embodiment.
Figure 21:
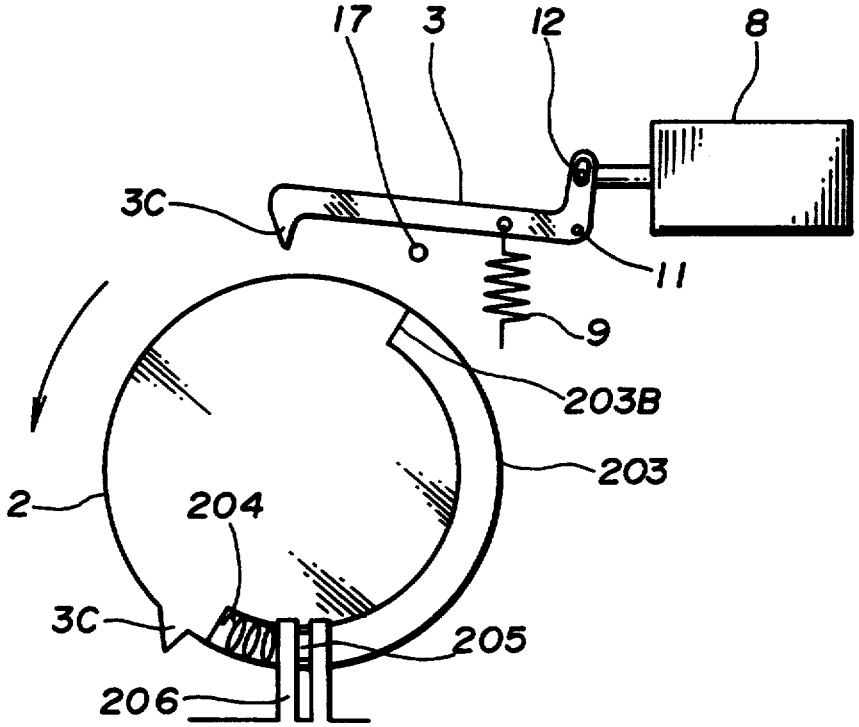
FIG. 21 is a diagram illustrating a state in which the locking of the cartridge is released in the third embodiment.

FIG. 18 is a schematic perspective view illustrating a state in the third embodiment, in which developer supply cartridge 10 is inserted into developer receptacle 302, is then rotated, and is locked by a reverse-rotation preventing mechanism. FIGS. 19 through 21 are diagrams illustrating the operations of respective units of the developer supply device of the present embodiment.

In this embodiment, a single projection 2A is provided on the outer circumferential surface of lid 2 of developer supply cartridge 10, and a substantially circular groove 203 is formed along the inner circumference of lid 2. This groove 203 is formed from position 203A near the right side of projection 2A, as viewed in FIG. 19, in a counterclockwise direction up to position 203B substantially facing position 203A in the direction of the diameter of lid 2. A coil spring 204 is inserted within the groove 203 at the side of projection 2A of lid 2. One end of coil spring 204 is fixed to one end portion 203A of groove 203 near projection 2A. Another end of coil spring 204 is fixed to supporting member 205, which is movable within the circular groove 203.

Fixing member 206 for grasping and holding supporting member 205 of coil spring 204 is provided on developer receptacle 302. As shown in FIG. 19, when developer supply cartridge 10 is inserted into developer receptacle 203, supporting member 205 for coil spring 204 is grasped and fixed by fixing member 206. At that time, coil spring 204 is in a compressed state in which it does not have an elastic force.

Developer supply cartridge 10 is rotatable around its central axis after being inserted within developer receptacle 302. The angle of rotation of developer supply cartridge 10 is regulated by the contact of supporting member 205 for coil spring 204 with one end portion 203A of groove 203 via coil spring 204, and by the direct contact of supporting member 205 with another end portion 203B of groove 203.

When supplying the developer into developer receptacle 302, lid 2 of developer supply cartridge 10 first has the posture shown in FIG. 19, and developer supply cartridge 10 is then inserted into holding portion 303 of developer receptacle 302. That is, the above-described guide groove is provided so that lid 2 cannot be inserted unless it has the posture shown in FIG. 19. At that time, opening 1A for discharging the developer is placed upward, so that the developer is not discharged. As described above, supporting member 205 for coil spring 204 is grasped and held by fixing member 206. At that time, coil spring 204 is in the compressed state in which it does not have an elastic force, and solenoid 8 is not excited. Hence, locking member 3 contacts stop member 17 by the function of tension spring 9.

Thereafter, in order to supply developer receptacle 302 with the developer within developer supply cartridge 10, developer supply cartridge 10 is rotated from the state shown in FIG. 19 in a clockwise direction as indicated by the arrow shown in FIG. 20. At that time, projection 2A of lid 2 passes through projection 3C of locking member 3 while raising it. The rotation of developer supply cartridge 10 in the clockwise direction stops at the angular position of developer supply cartridge 10 (a predetermined position for supplying the developer) provided when projection 2A of lid 2 passes through projection 3C of locking member 3. This is because further rotation of developer supply cartridge 10 in the clockwise direction becomes impossible since supporting member 205 for coil spring 204 contacts the other end portion 203B of groove 203 at the above-described angular position.

At the same time, since opening 1A of developer supply cartridge 10 is placed downward, the developer is supplied into developer receptacle 302. On the other hand, the rotation of developer supply cartridge 10 in a counterclockwise direction becomes impossible, since projection 2A of lid 2 is locked by projection 3C of locking member 3 driven by spring 9.

On the other hand, as shown in FIG. 20, coil spring 204 within groove 203 is in a state of being extended to a maximum amount within its elastic limit by the rotation of developer supply cartridge 10 in the clockwise direction, and therefore stores an elastic force (a force to return developer supply cartridge 10 in a counterclockwise direction).

When the developer has been consumed in accordance with the proceeding of image forming processes, and the above-described remaining-amount detection sensor of the developing device has detected that the amount of developer particles within developer receptacle 302 becomes leas than the predetermined amount as described with reference to FIG. 11, solenoid 8 operates to retract its driving shaft. Hence, locking member 3 starts to be rotated around shaft 11 in a clockwise direction by shaft 12 provided at an end portion of the driving shaft of solenoid 8.

As shown in FIG. 21, when solenoid 8 has completely retracted its driving shaft, locking member 3 is moved upward, so that the locked state between projection 3C of locking member 3 and projection 2C of lid 2 is released. By the release of the locked state, developer supply cartridge 10 instantaneously returns to the original position (the position to insert developer supply cartridge 10) by the above-described elastic force of coil spring 204, as illustrated in FIG. 21. At that time, no developer particles remain within developer supply cartridge 10.

When the main power supply of the image forming apparatus has been turned off to turn off solenoid 8, locking member 3 is pushed downward (in a counterclockwise direction) by the elastic force of tension spring 9 and stops in a state in which it contacts stop member 17, as illustrated in FIG. 19. Of course, as in the above-described embodiment, when the amount of developer particles within developer receptacle 302 becomes less than a predetermined amount, solenoid 8 may be turned on for a predetermined time period in response to a detection signal generated from the remaining-amount detection sensor.

As described above, the operator to replenish the developer can detach developer supply cartridge 10 inserted in developer receptacle 302. At that time, no developer particles remain within developer supply cartridge 10, and developer particles within developer receptacle 302 do not contact developer supply cartridge 10. Hence, it is possible to completely overcome the problem that developer particles are spilt or scattered.

Next, a description will be provided of a fourth embodiment of the present invention.

Figure 22:
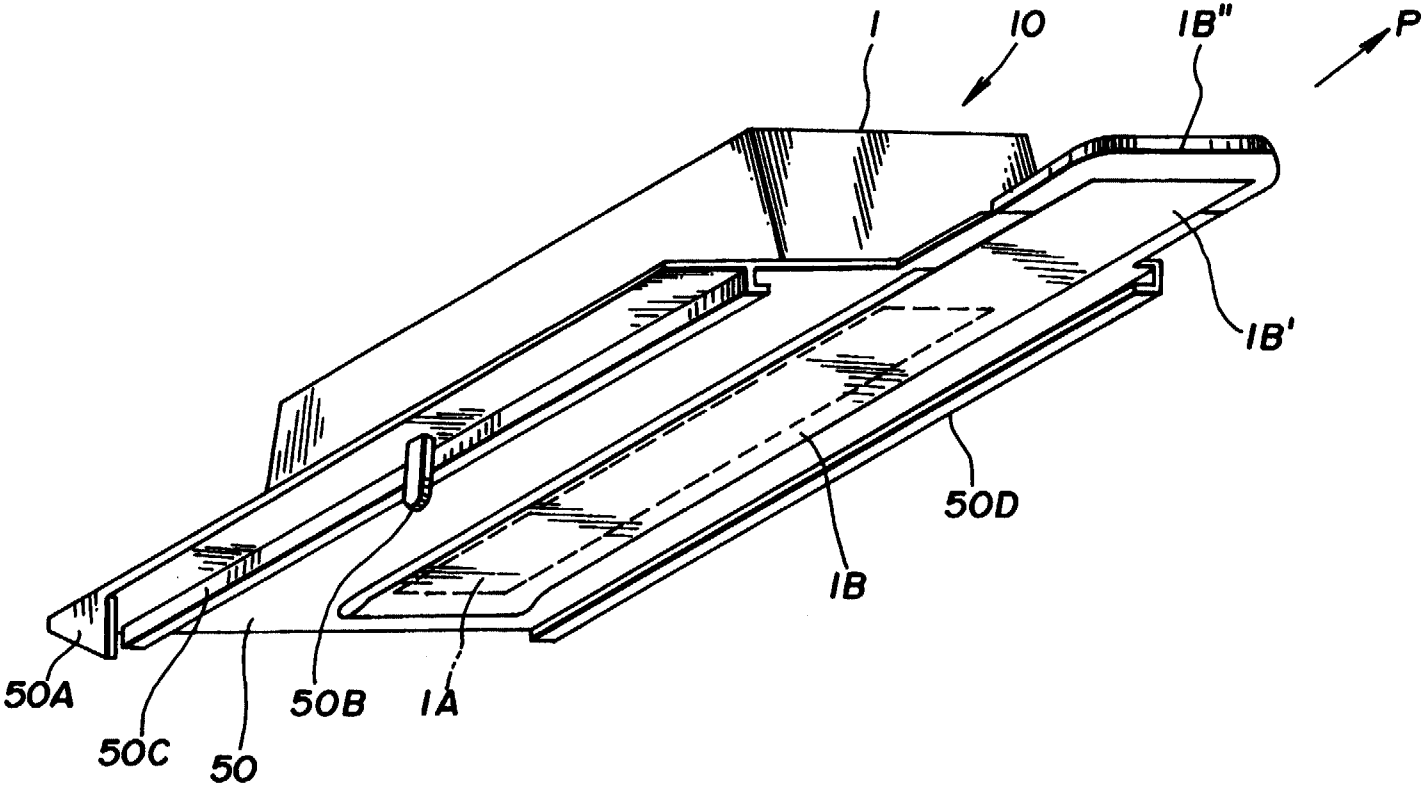
FIG. 22 is a perspective view of a cartridge, as seen from below, used in a fourth embodiment of the present invention.

In this embodiment, as shown in FIG. 22, developer supply cartridge 10 includes a rectangular receptacle 1 for accommodating a developer to be supplied. Opening 1A for discharging the developer is provided in flange unit 50 provided at this receptacle 1. In the same manner as described with reference to FIG. 8, this opening 1A is sealed by peelably attaching one portion of twice-folded flexible film 1B to flange unit 50 at the circumference of opening 1A. By pulling gripper 1B" fixed to leading-end portion 1B' of the twice-folded film 1B in the direction of arrow P, the operator can peel film 1B from flange unit 50. That is, the operator can open opening 1A.

Figure 23:
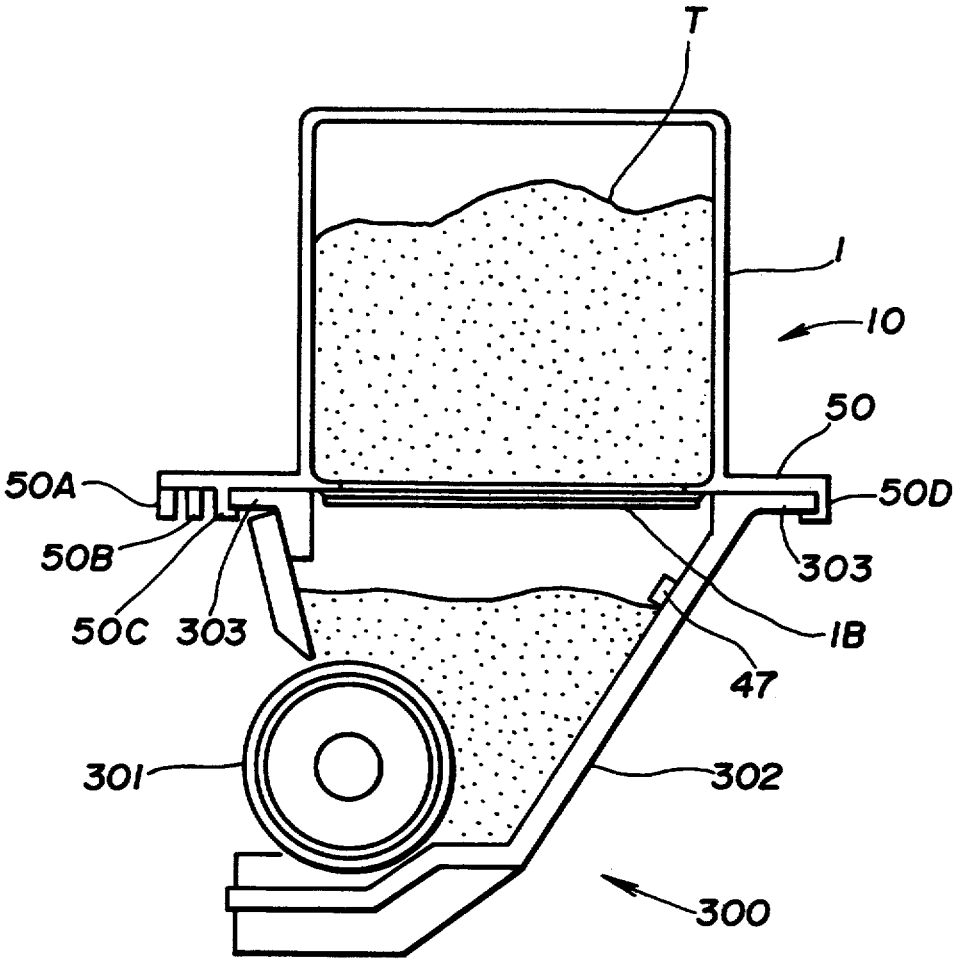
FIG. 23 is a diagram illustrating a principal portion of the fourth embodiment.

Guide rails 50C and 50D are provided on flange unit 50. As shown in FIG. 23, guide rails 50C and 50D engage with side ends of cartridge holding portion 303 of developing device 300 so as to guide the linear movement of developer supply cartridge 10 on holding portion 303. Guide rails 50C and 50D prevent developer supply cartridge 10 from being raised upward from holding portion 303 in a state in which developer supply cartridge 10 is held on holding portion 303. Locking-member-engaging projection 50A and lever-engaging projection 50B are provided on flange unit 50 of developer supply cartridge 10.

Developer supply cartridge 10 is first mounted on cartridge holding portion 303 of developing device 300, and guide rails 50C and 50D engage with the two side ends of holding portion 303, as illustrated in FIG. 23. Thereafter, as illustrated in FIG. 24, developer supply cartridge 10 is linearly moved in the direction of arrow F by the operator.

Figure 24:
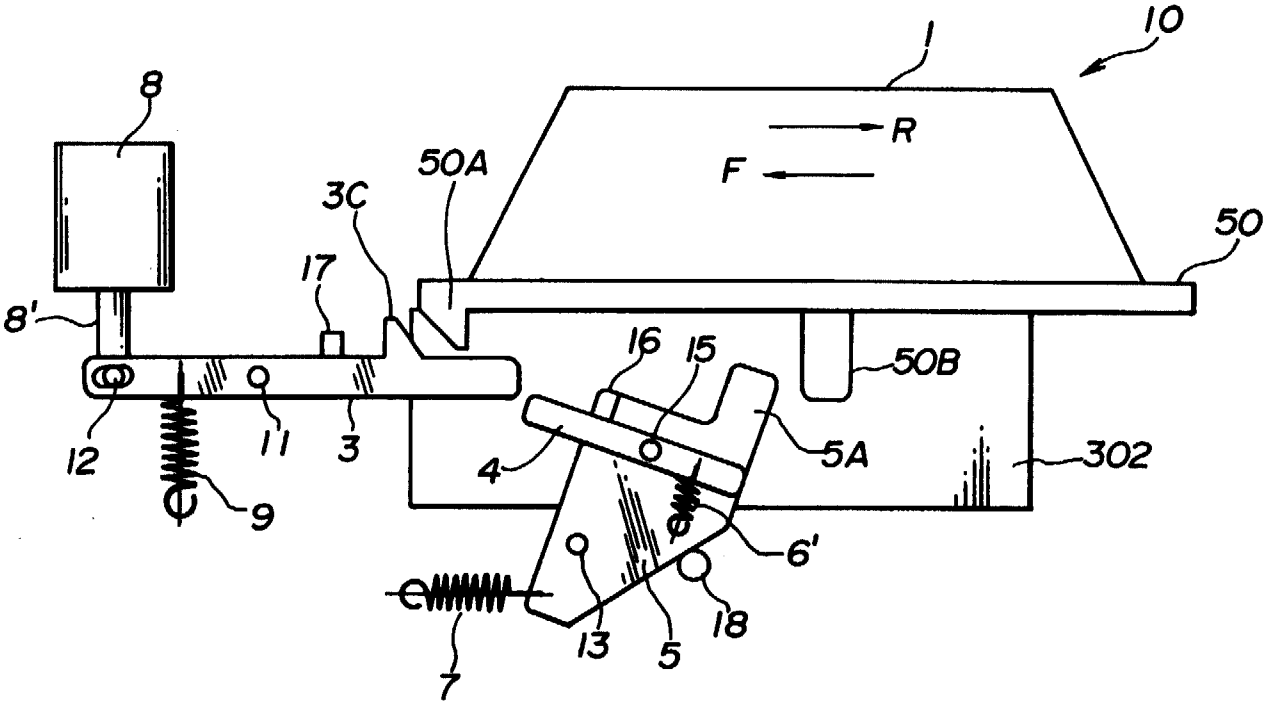
FIG. 24 is a diagram illustrating a state immediately before the cartridge reaches a predetermined position, and a state immediately after the cartridge has left the predetermined position.

As shown in FIG. 24, components having the same functions as the above-described functions are provided in developing device 300.

That is, locking lever 3 having locking pawl 3C is provided so as to be rotatable around shaft 11. This lever 3 is elastically driven in a counterclockwise direction by spring 9, one end of which is fixed to a fixing shaft (not shown), and another end of which is fixed to lever 3. In the case of FIG. 24, lever 3 engages with stopper 17, so that the rotation of lever 3 in a counterclockwise direction is prevented, and lever 3 is held at the position shown in FIG. 24. As will be described later, lever 3 rotates in a clockwise direction by a predetermined angle when electromagnetic plunger 8 operates.

Lever 5 is provided so as to be rotatable around shaft 13. This lever 5 is elastically driven in a clockwise direction by spring 7, one end of which is fixed to a fixing shaft (not shown), and another end of which is fixed to lever 5. In the case of FIG. 24, lever 5 engages with stopper 18, so that the rotation of lever 5 in a clockwise direction is prevented, and lever 5 is held at the position shown in FIG. 24.

Stopper lever 4 is rotatably supported on shaft 15 secured on lever 5, and is elastically driven in a clockwise direction by spring 6', one end of which is fixed to a shaft secured on lever 5, and another end of which is fixed to lever 4. In the case of FIG. 24, lever 4 engages with stopper 16 secured on lever 5, so that the rotation of lever 4 S in a clockwise direction is prevented, and lever 4 is held at the position shown in FIG. 24.

When developer supply cartridge 10 is further moved from the position shown in FIG. 24 in the direction of arrow F, an inclined cam surface of projection 50A of developer supply cartridge 10 contacts locking pawl 3C of locking lever 3, and projection 50B of developer supply cartridge 10 contacts projection 5A of lever 5.

When developer supply cartridge 10 is further moved in the direction of arrow F, projection 50A pushes locking pawl 3C downward to rotate locking lever 3 in a clockwise direction against the elastic force of spring 9, and passes through locking pawl 3C.

Figure 25:
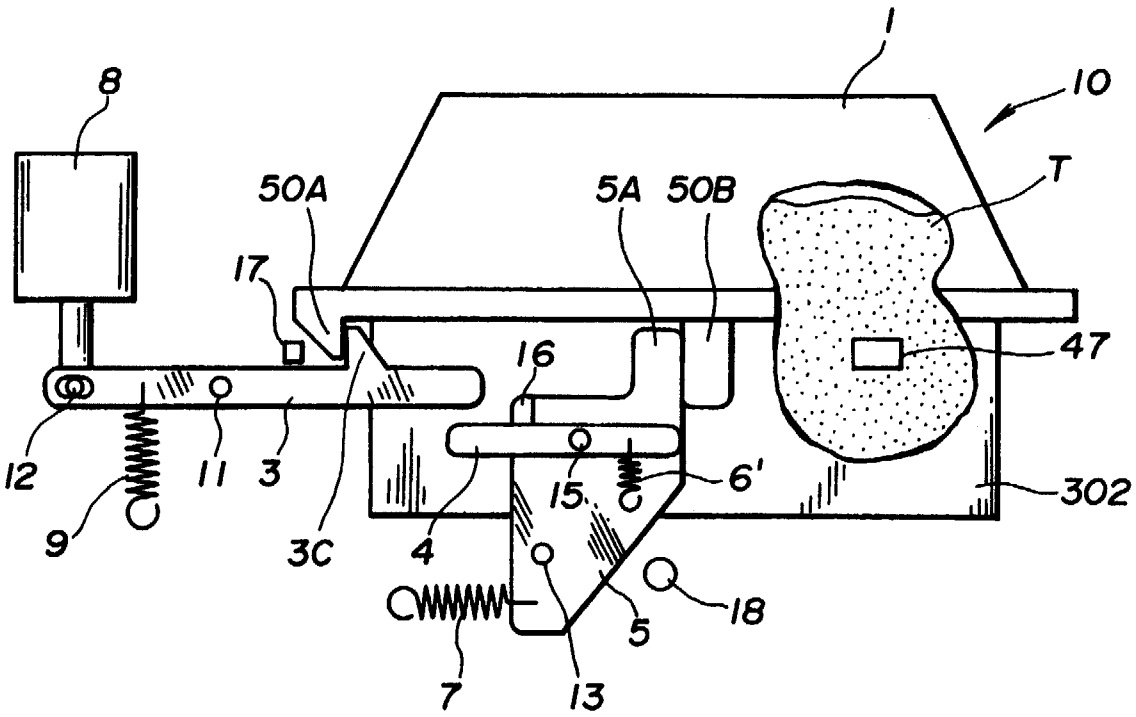
FIG. 25 is a diagram illustrating a state in which the cartridge is locked in the fourth embodiment.

As soon as projection 50A of developer supply cartridge 10 has passed through locking pawl 8C, locking lever 3 rotates in a counterclockwise direction by the elastic force of spring 9, and locking pawl 3C returns to the position to provide a locking operation to engage with projection 50A and to prevent the detachment of developer supply cartridge 10 in a direction opposite to the direction of arrow F (see FIG. 25).

On the other hand, projection 50B of developer supply cartridge 10 pushes projection 5A of lever 5 against the elastic force of spring 7 to position lever 5 at the position shown in FIG.

In the state shown in FIG. 25, the operator removes the above-described seal film 1B from developer supply cartridge 10, whereby developer T within developer supply cartridge 10 is supplied into developer receptacle 302.

When electrostatic latent images have been repeatedly developed, and the amount of developer T within developer supply cartridge 10 has been reduced to such an amount that developer particles do not contact developer supply cartridge 10 held in holding portion 303, current is supplied to solenoid 8 in response to a signal from developer-remaining-amount detection sensor 47 provided in developer receptacle 302. Thus, as illustrated in FIG. 26, solenoid 8 rotates locking lever 3 in a clockwise direction against the elastic force of spring 9.

Figure 26:
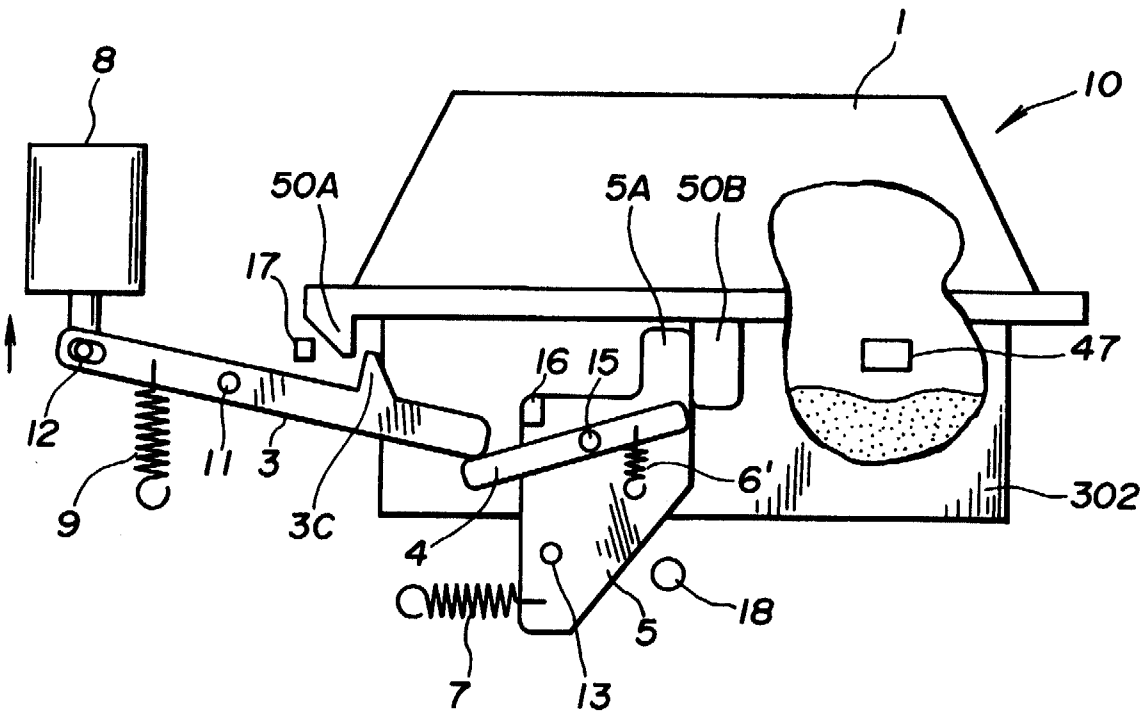
FIG. 26 is a diagram illustrating a locking-releasing operation in the fourth embodiment.

As shown in FIG. 26, by the rotation of lever 3 in the clockwise direction, a leading-end portion of lever 3 presses a leading-end portion of stopper lever 4 downward to rotate lever 4 in a counterclockwise direction against the elastic force of spring 6'.

Figure 27:
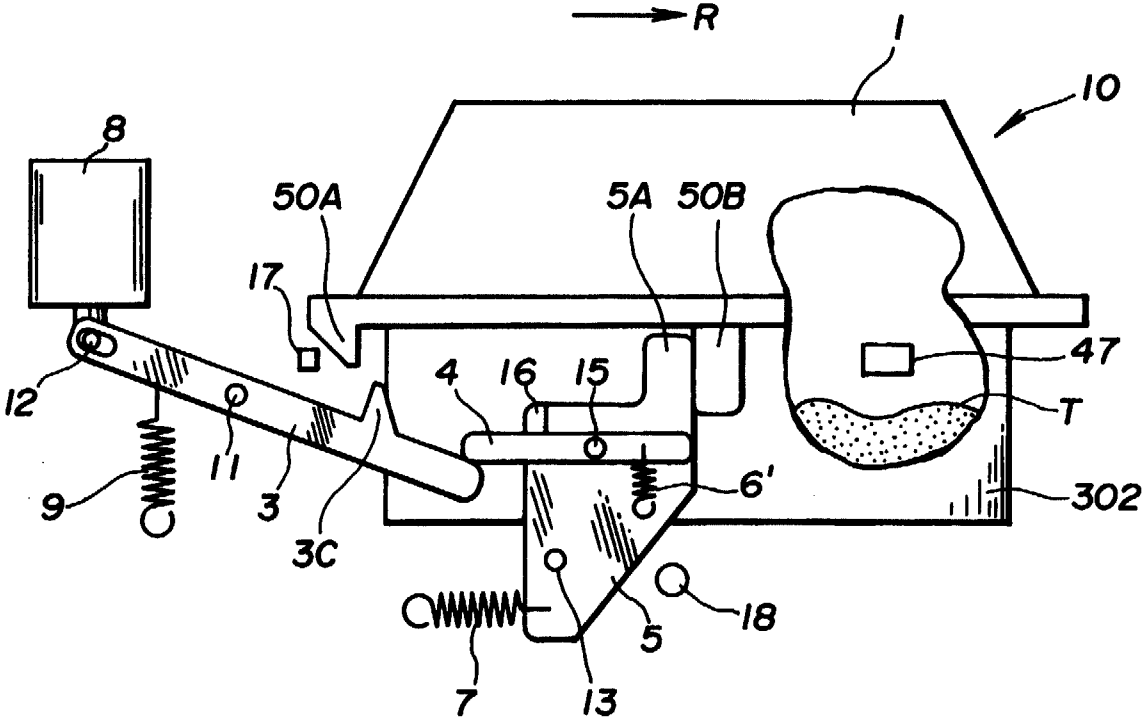
FIG. 27 is a diagram illustrating a state in which the locking of the cartridge is released.

As soon as locking lever 3 has further rotated in the 10 clockwise direction and the leading-end portion of lever 3 has passed through the leading-end portion of stopper lever 4, stopper lever 4 is rotated around shaft 15 in a clockwise direction by the elastic force of spring 6' to again engage with stopper 16, and is held at the position shown in FIG. 27.

Immediately after stopper lever 4 has assumed the state shown in FIG. 27, the current supply to solenoid 8 is interrupted to deenergize solenoid 8. However, as shown in FIG. 27, since the leading-end portion of stopper 4 presses the leading-end portion of locking lever 3, locking lever 3 is held at the locking releasing position, in which locking pawl 3C is separated from projection 50A of developer supply cartridge 10, although the elastic force of spring 9 is applied to locking lever 3.

After the state shown in FIG. 27 has been provided, the operator can detach developer supply cartridge 10 in the direction of arrow R, which is opposite to the direction of arrow F, at any time. When developer supply cartridge 10 is moved in the direction of arrow R, lever 5, on which stopper lever 4 is provided, rotates around shaft 13 in a clockwise direction until it contacts stopper 18 by the elastic force of spring 7. The leading-end portion of stopper lever 4 is thereby retracted from the position where it presses the leading-end portion of locking lever 3, whereby locking lever 3 returns to the position where it engages with stopper 17 by the elastic force of spring 9, as illustrated in FIG. 27. At that time, projection 50A of developer supply cartridge 10 has moved to the position where it does not engage with locking pawl 3C.

Thus, the operator can detach developer supply cartridge 10 from cartridge holding portion 303 of the developing device.

Also in this embodiment, solenoid 8 is controlled by the control means shown in FIG. 11.

A description will now be provided of a fifth embodiment of the present invention. In the fifth embodiment, the same developer supply cartridge and holding portion as those of the fourth embodiment are used. The fifth embodiment differs from the fourth embodiment in its locking mechanism and control means therefor.

Figure 28:
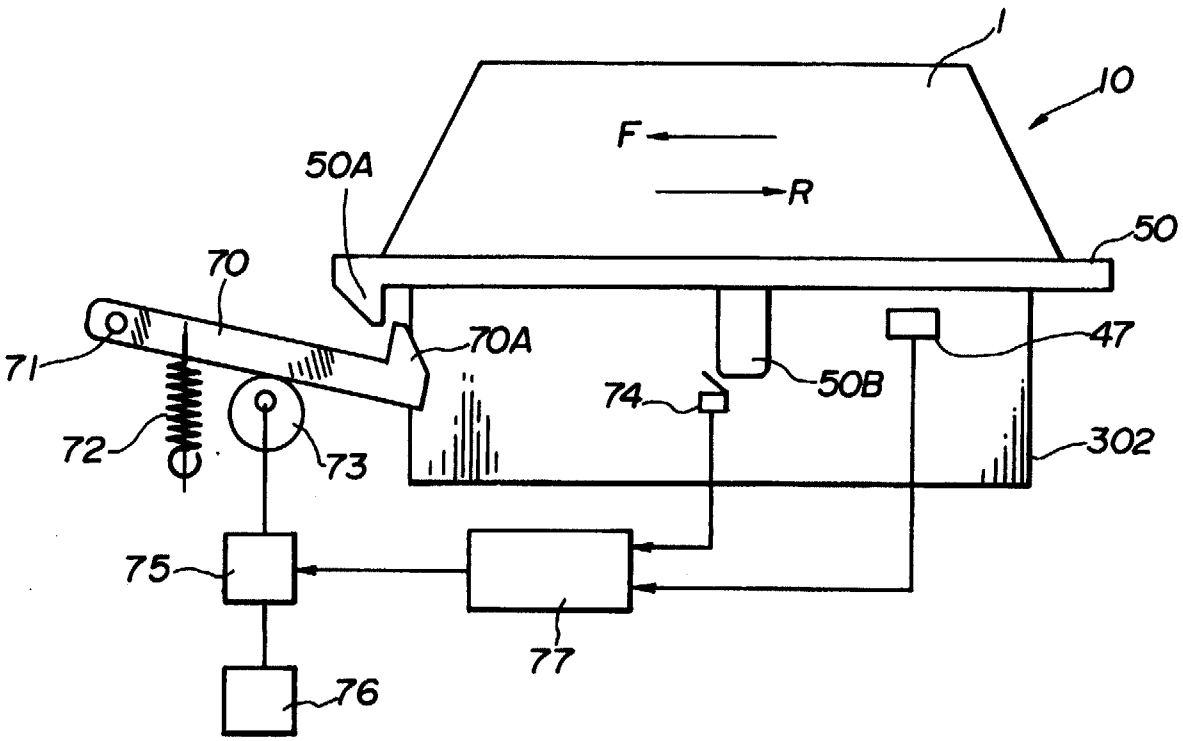
FIG. 28 is a diagram illustrating a state immediately before a cartridge is locked, and a state immediately after the locking of the cartridge has been released in a fifth embodiment of the present invention.

In FIG. 28, locking lever 70 having locking pawl 70A is rotatable around shaft 71. One end of spring 72 is fixed to a fixing shaft (not shown), and another end of spring 72 is fixed to locking lever 70. Spring 72 elastically drives locking lever 70 in a clockwise direction, so that locking lever 70 is in pressure contact with eccentric cam 73.

In FIG. 28, locking lever 70 is positioned at a non-locking position where its pawl 70A does not engage with projection 50A of developer supply cartridge 10.

In the state shown in FIG. 28, developer supply cartridge 10 is mounted the cartridge holding portion of the developing device, and is pushed in the direction of arrow F as in the above-described manner. When developer supply cartridge 10 reaches a predetermined position for discharging the developer into developer receptacle 302, projection 50B of developer supply cartridge 10 closes microswitch 74, serving as a position detection sensor.

When microswitch 74 is closed in the above-described manner, control circuit 77, comprising a microcomputer and the like, energizes clutch 75 in response to a signal from microswitch 74. This clutch 75 transmits the driving force of motor 76 to eccentric cam 73 to rotate it. By the rotation of cam 73, locking lever 70 is rotated in a counterclockwise direction to raise locking pawl 70A.

Figure 29:
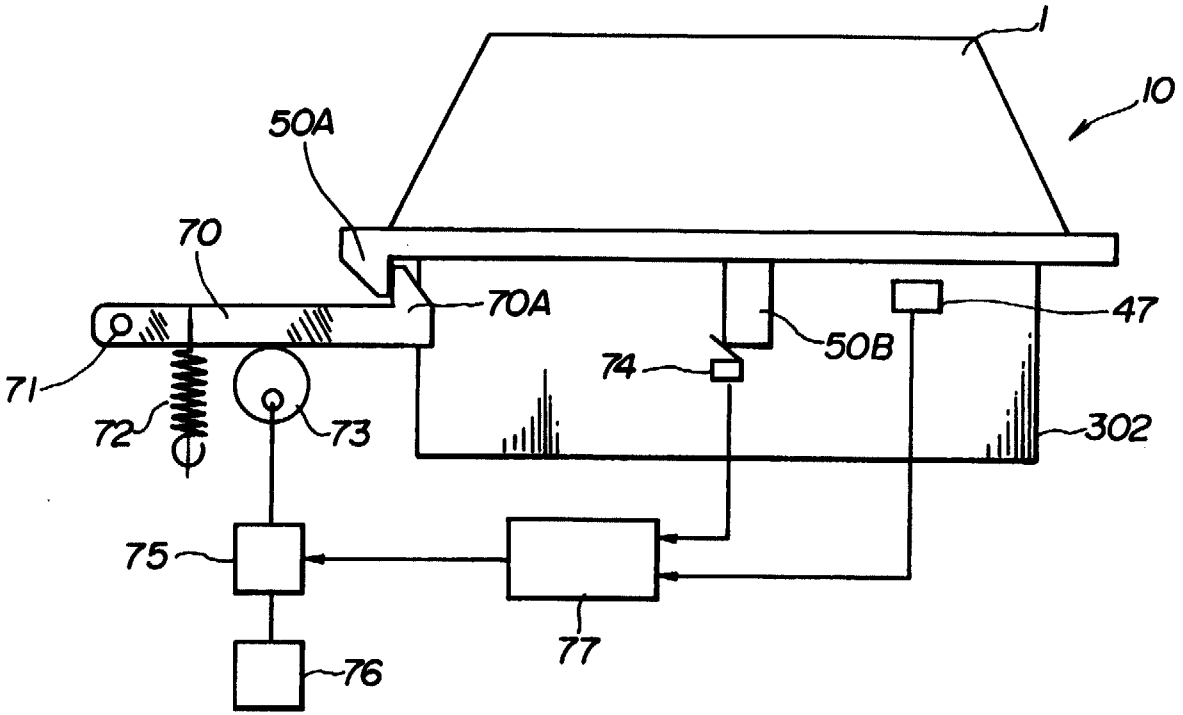
FIG. 29 is a diagram illustrating a state in which a the cartridge is locked in the fifth embodiment.

When locking lever 70 reaches the position shown in FIG. 29 by the rotation of cam 73 by 180°, control circuit 77 deenergizes clutch 75. In the state shown in FIG. 29, locking pawl 70A engages with projection 50A of developer supply cartridge 10 to prevent the movement of developer supply cartridge 10 in the direction of arrow R. In this state, the above-described sealing film is removed from developer supply cartridge 10, whereby the developer is supplied from developer supply cartridge 10 into developer receptacle 302.

When electrostatic latent images have been repeatedly developed, and remaining-amount detection sensor 47 has detected that the amount of developer particles remaining within developer receptacle 302 has decreased to a level of not contacting developer supply cartridge 10 held in the holding portion, control circuit 77 again energizes clutch 75 in response to a signal from remaining-amount detection sensor 74.

Eccentric cam 73 thereby starts to rotate, and locking lever 70 starts to rotate around shaft 71 in a clockwise direction. When locking lever 70 reaches the position shown in FIG. 28 by the rotation of eccentric cam 73 by 180°, control circuit 77 deenergizes clutch 75.

In the state shown in FIG. 28, locking pawl 70A does not engage with projection 50A of developer supply cartridge 10. Accordingly, the operator can thereafter detach developer supply cartridge 10 in the direction of arrow R at any time.

Figure 30:
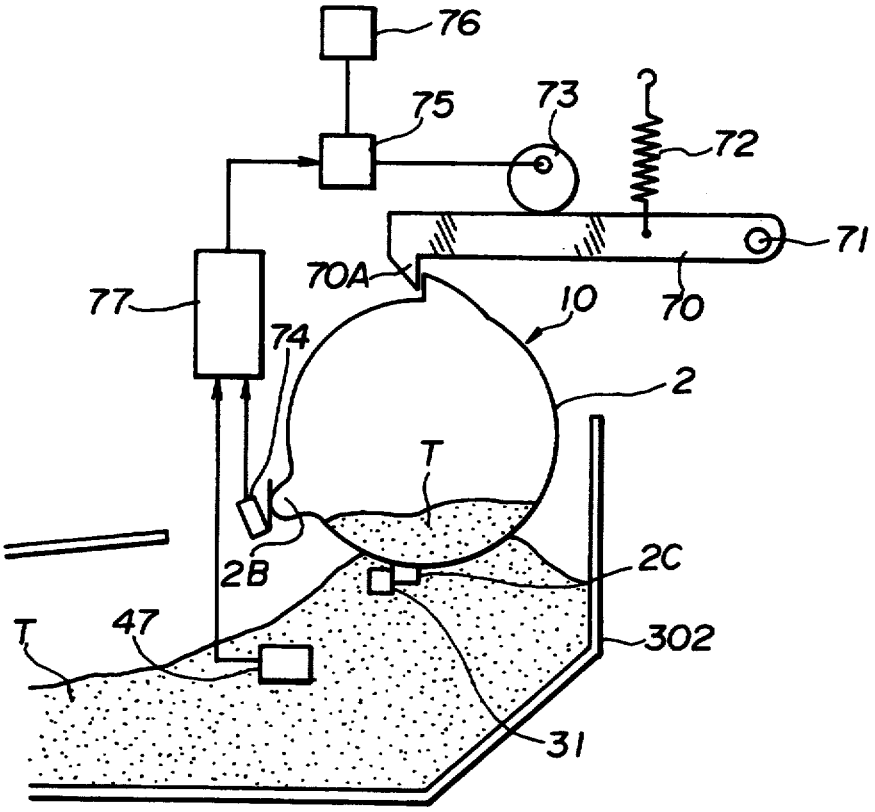
FIG. 30 is a diagram illustrating the configuration of a sixth embodiment of the present invention.

Also in the first embodiment, locking means may be configured in the same manner as in the fifth embodiment. FIG. 30 illustrates the configuration of such an embodiment. In FIG. 30, a state is shown in which developer supply cartridge 10 is rotated after being inserted in the holding portion as shown in FIG. 3, and the locking is completed.

In FIG. 30, members and means having the same functions as those shown in FIGS. 2–10, 28 and 29 are indicated by the same reference numerals, and a detailed description thereof will be omitted in order to prevent complication.

In the embodiment shown in FIG. 30, however, projection 2A of developer supply cartridge 10 does not raise locking pawl 70A. In addition, projection 2B operates on position detection sensor 74.

In this embodiment, all developer particles are not discharged into developer receptacle 302 immediately after a new cartridge is mounted in the cartridge holding portion of the developing device. In a stage in which the used cartridge is detached from the holding portion, a new cartridge is mounted, and the opening of the new cartridge is unsealed, a part of the developer within the cartridge is discharged into the developer receptacle, but the other part of the developer remains within the cartridge. That is, sensor 47 detects the amount of the developer remaining within the developer receptacle which can realize the above-described state.

As electrostatic latent images are repeatedly developed, and the developer within the developer receptacle is gradually consumed, the developer within the cartridge is gradually discharged into the developer receptacle.

That is, in this embodiment, the cartridge functions as a part of a hopper which stores the developer for the developing device while being mounted in the developing device.

Accordingly, the size reduction of the developing device can be easily realized in this embodiment compared with an apparatus in which the developer within the cartridge is entirely discharged into the developer receptacle when the cartridge has been mounted in the developing device.

Furthermore, in this embodiment, the locked state of the cartridge is released when the amount of the developer within the developer receptacle is reduced to such a predetermined amount that the developer does not contact the cartridge held in the holding portion. Hence, it is possible to prevent the accident that the cartridge is detached from the holding portion in a state in which a large amount of the developer remains within the cartridge.

The individual components shown in outline or designated by blocks in the drawings are all well-known in the developing device and the developer supply cartridge arts and their specific construction and operation are not critical to the operation or best mode for carrying out the invention.

While the present invention has been described with respect to what is presently considered to be the preferred embodiments, it is to be understood that the invention is 10 not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developing device for developing an electrostatic image, in which a developer supply cartridge is detachably mounted, comprising:

a receptacle for accommodating a developer discharged from the cartridge;

developing means for developing the electrostatic image with the developer accommodated in said receptacle;

locking means for selectively preventing detaching of the cartridge, said locking means comprising an acting member which operates when electric power is supplied so as to allow detaching of the cartridge;

detection means for detecting an amount of the developer;

electric power supply means for supplying the electric power to said acting member on the basis of detection output of said detection means; and keeping means for keeping the cartridge detachable mechanically.

2. A device according to claim 1, wherein said detection means detects the amount of the developer within said receptacle.

3. A device according to claim 1, wherein said electric power supply means supplies the electric power to said acting member when said detection means detects that the amount of the developer is under a predetermined amount.

4. A device according to claim 1, wherein the cartridge is configured to move between a detaching position and a non-detaching position, and said locking means prevents the cartridge from moving from the non-detaching position to the detaching position.

5. A device according to claim 4, wherein said locking means locks the cartridge mechanically in response to movement of said cartridge from the detaching position to the non-detaching position.

6. A device according to claim 4, wherein said cartridge is configured so that the developer within the cartridge is not discharged into said receptacle at the detaching position but is discharged into said receptacle at the non-detaching position.

7. A device according to claim 4, wherein the cartridge is substantially cylindrical and rotates between the detaching position and the non-detaching position.

8. A device according to claim 1, wherein said locking means further comprises a lock lever to lock the cartridge by engaging with the cartridge, and said keeping means comprises a stopper which prevents said lock lever from engaging with the cartridge.

9. A device according to claim 1, wherein said electric power supply means comprises current supply means.

* * * * *

UNITED STATES PATENT AND TRADEMARK OFFICE

CERTIFICATE OF CORRECTION

PATENT NO. : 5,430,531

DATED : July 4, 1995

INVENTOR(S) : Daisaku Kamiya

It is certified that error appears in the above-indentified patent and that said Letters Patent is hereby corrected as shown below:

Column 3:

Line 65, "a the" should read --the--.

Column 4:

Line 11, "drum" should read --drum 304--; and
Line 62, "lid 2," should read --lid 2'--.

Column 5:

Line 67, "tacle" should read --tacle 302.--.

Column 6:

Line 14, "member" should read --member 16.--.

Column 12:

Line 26, "leas" should read --less--.

UNITED STATES PATENT AND TRADEMARK OFFICE

CERTIFICATE OF CORRECTION

PATENT NO. : 5,430,531

DATED : July 4, 1995

INVENTOR(S) : Daisaku Kamiya

It is certified that error appears in the above-indentified patent and that said Letters Patent is hereby corrected as shown below:

COLUMN 13:

Line 59, "lever 4 S" should read --lever 4--.

COLUMN 16:

Line 61, "10" should be deleted.

Signed and Sealed this

Seventh Day of November, 1995

Bruce Lehman

*Attest:*

BRUCE LEHMAN

*Attesting Officer*

*Commissioner of Patents and Trademarks*